US007416637B2

(12) United States Patent
Murray et al.

(10) Patent No.: US 7,416,637 B2
(45) **Date of Patent: *Aug. 26, 2008**

(54) LOW COMPACTION, PNEUMATIC DEWATERING PROCESS FOR PRODUCING ABSORBENT SHEET

(75) Inventors: Frank C. Murray, Marietta, GA (US); Greg A. Wendt, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 474 days.

This patent is subject to a terminal disclaimer.

(21) Appl. No.: 11/167,348

(22) Filed: Jun. 27, 2005

(65) Prior Publication Data

US 2006/0000567 A1 Jan. 5, 2006

Related U.S. Application Data

(60) Provisional application No. 60/584,901, filed on Jul. 1, 2004.

(51) Int. Cl.
*D21F 11/00* (2006.01)
*D21H 25/00* (2006.01)

(52) U.S. Cl. ..... 162/111; 162/109; 162/113; 162/116; 162/205; 162/207

(58) Field of Classification Search ..... 162/109–117, 162/197, 205–207, 270, 271, 280, 306, 308, 162/312, 348, 358.2, 900, 902, 903; 428/152–154, 428/156, 174; 264/282
See application file for complete search history.

(56) References Cited

U.S. PATENT DOCUMENTS 3,058,873 A 10/1962 Keim et al. ..... 162/164

(Continued)

FOREIGN PATENT DOCUMENTS

CA 2053505 4/1992
WO WO 00/14330 3/2000

OTHER PUBLICATIONS

Chapter 2: Alkaline-Curing Polymeric Amine-Epichlorohydrin by Espy in Wet Strength Resins and Their Application (L. Chan, Editor, 1994); Westfelt in Cellulose Chemistry and Technology vol. 13, p. 813, 1979; Evans, Chemistry and Industry, Jul. 5, 1969, pp. 893-903; Egan, J.Am. Oil Chemist's Soc., vol. 55 (1978), pp. 118-121; and Trivedi et al., J.Am.Oil Chemist's Soc., Jun. 1981, pp. 754-756.

(Continued)

*Primary Examiner*—Eric Hug
(74) *Attorney, Agent, or Firm*—Michael W. Ferrell

(57) ABSTRACT

A low-compaction method of making an absorbent cellulosic web includes: forming a nascent web from a papermaking furnish; dewatering the nascent web to a consistency of from about 10 to about 30 percent on a foraminous forming support traveling at a first speed; rush-transferring the web at a consistency of from 10 to about 30 percent to an open texture fabric traveling at a second speed slower than the first speed of the forming support; further dewatering the web on the impression fabric to a consistency of from about 30 to about 60 percent by way of (i) combining the open texture fabric bearing said web with a fluid distribution membrane and an anti-rewet felt as the three pass through a nip into a pressure chamber defined in part by a plurality of nip rolls, the fluid distribution membrane bearing against the side of the open texture fabric away from the web, with the anti-rewet felt bearing against the web, and (ii) applying a pneumatic pressure gradient from the distributor membrane through the web thereby dewatering the web; and drying the web. Preferably the process includes the steps of selecting the papermaking furnish and controlling the process such that the dried web has a void volume fraction of at least 0.7, a hydraulic diameter in the range of from about 3 to about 20 microns and a Wet Springback Ratio of at least about 0.65. Optionally provided is a high solids fabric crepe in a pressure nip.

6 Claims, 19 Drawing Sheets

U.S. PATENT DOCUMENTS

| | | | | |
|---|---|---|---|---|
| 3,556,932 | A | 1/1971 | Coscia et al. | 162/166 |
| 3,556,933 | A | 1/1971 | Williams et al. | 162/167 |
| 3,700,623 | A | 10/1972 | Keim | 260/80.3 R |
| 3,772,076 | A | 11/1973 | Keim | 117/155 R |
| 3,974,025 | A | 8/1976 | Ayers | 162/113 |
| 3,994,771 | A | 11/1976 | Morgan, Jr. et al. | 162/113 |
| 4,102,737 | A | 7/1978 | Morton | 162/113 |
| 4,225,382 | A | 9/1980 | Kearney et al. | |
| 4,239,065 | A | 12/1980 | Trokhan | 139/383 A |
| 4,420,372 | A | 12/1983 | Hostetler | 162/280 |
| 4,440,597 | A | 4/1984 | Wells et al. | 162/111 |
| 4,445,638 | A | 5/1984 | Connell et al. | 237/8 R |
| 4,482,429 | A | 11/1984 | Klowak | 162/111 |
| 4,490,925 | A | 1/1985 | Smith | 34/42 |
| 4,528,316 | A | 7/1985 | Soerens | 524/503 |
| 4,529,480 | A | 7/1985 | Trokhan | 162/109 |
| 4,543,156 | A | 9/1985 | Cheshire et al. | 162/101 |
| 4,551,199 | A | 11/1985 | Weldon | 162/109 |
| 4,605,702 | A | 8/1986 | Guerro et al. | 525/154 |
| 4,689,119 | A | 8/1987 | Weldon | 162/281 |
| 4,720,383 | A | 1/1988 | Drach et al. | 424/70 |
| 4,834,838 | A | 5/1989 | Klowak | 162/109 |
| 4,849,054 | A | 7/1989 | Klowak | 162/109 |
| 5,223,096 | A | 6/1993 | Phan et al. | 162/158 |
| 5,262,007 | A | 11/1993 | Phan et al. | 162/158 |
| 5,264,082 | A | 11/1993 | Phan et al. | 162/158 |
| 5,312,522 | A | 5/1994 | Phan et al. | 162/111 |
| 5,415,737 | A | 5/1995 | Phan et al. | 162/111 |
| 5,449,026 | A | 9/1995 | Lee | 139/383 A |
| 5,593,545 | A | 1/1997 | Rugowski et al. | 162/207 |
| 5,607,551 | A | 3/1997 | Farrington, Jr. et al. | 162/109 |
| 5,690,149 | A | 11/1997 | Lee | 139/383 A |
| 5,961,782 | A | 10/1999 | Luu et al. | 162/111 |
| 6,080,279 | A | 6/2000 | Hada et al. | 162/290 |
| 6,083,346 | A | 7/2000 | Hermans et al. | 162/115 |
| 6,093,284 | A | 7/2000 | Hada et al. | 162/290 |
| 6,096,169 | A | 8/2000 | Hermans et al. | 162/115 |
| 6,133,405 | A | 10/2000 | Allen | 528/310 |
| 6,143,135 | A | 11/2000 | Hada et al. | 162/290 |
| 6,161,303 | A | 12/2000 | Beck | 34/119 |
| 6,190,506 | B1 | 2/2001 | Beck | 162/357 |
| 6,207,011 | B1 | 3/2001 | Luu et al. | 162/111 |
| 6,228,220 | B1 | 5/2001 | Hada et al. | 162/203 |
| 6,248,203 | B1 | 6/2001 | Beck | 156/286 |
| 6,274,042 | B1 | 8/2001 | Beck | 210/500.27 |
| 6,280,573 | B1 | 8/2001 | Lindsay et al. | 162/198 |
| 6,287,426 | B1 | 9/2001 | Edwards et al. | 162/281 |
| 6,287,427 | B1 | 9/2001 | Beck | 162/360.3 |
| 6,306,257 | B1 | 10/2001 | Hada et al. | 162/290 |
| 6,350,349 | B1 | 2/2002 | Hermans et al. | 162/111 |
| 6,381,868 | B1 | 5/2002 | Grabscheid et al. | 34/114 |
| 6,416,631 | B1 | 7/2002 | Beck | 162/360.3 |
| 6,419,793 | B1 | 7/2002 | Beck | 162/213 |
| 6,432,267 | B1 | 8/2002 | Watson | 162/111 |
| 6,447,640 | B1 | 9/2002 | Watson et al. | 162/101 |
| 6,454,904 | B1 | 9/2002 | Hermans et al. | 162/205 |
| 6,497,789 | B1 | 12/2002 | Hermans et al. | 162/205 |
| 6,562,198 | B2 | 5/2003 | Beck et al. | 162/360.3 |
| 6,579,418 | B2 | 6/2003 | Lindsay et al. | 162/198 |
| 6,589,394 | B2 | 7/2003 | Beck | 162/360.3 |
| 6,616,812 | B2 | 9/2003 | Beck | 162/358.2 |
| 6,645,420 | B1 | 11/2003 | Beck | 264/504 |
| 6,855,227 | B2 * | 2/2005 | Beck | 162/109 |
| 2003/0056919 | A1 | 3/2003 | Beck | 162/199 |
| 2003/0056921 | A1 | 3/2003 | Beck et al. | 162/290 |
| 2003/0056922 | A1 | 3/2003 | Beck | 162/290 |
| 2003/0056923 | A1 | 3/2003 | Beck | 162/290 |
| 2003/0056925 | A1 | 3/2003 | Beck | 162/159 |
| 2003/0146581 | A1 | 8/2003 | Beck | 277/159 |
| 2003/0153443 | A1 | 8/2003 | Beck | 492/159 |
| 2004/0089168 | A1 | 5/2004 | Beck | 100/159 |
| 2006/0289133 | A1 | 12/2006 | Yeh et al. | 162/109 |

OTHER PUBLICATIONS

U.S. Appl. No. 11/867,113, filed Oct. 4, 2007, Kokko et al.
U.S. Appl. No. 11/804,246, filed May 16, 2007, Edwards et al.
U.S. Appl. No. 11/678,669, filed Feb. 26, 2007, Chou et al.
U.S. Appl. No. 60/903,789, filed Feb. 27, 2007, Chou et al.
U.S. Appl. No. 60/881,310, filed Jan. 19, 2007, Sumnicht.

* cited by examiner

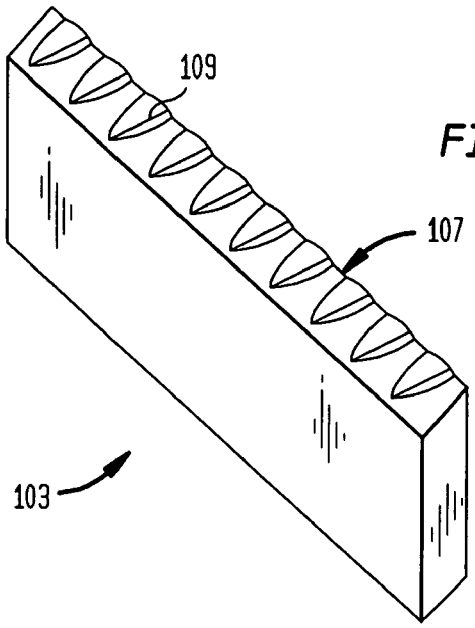
FIG. 19B
FIG. 19C
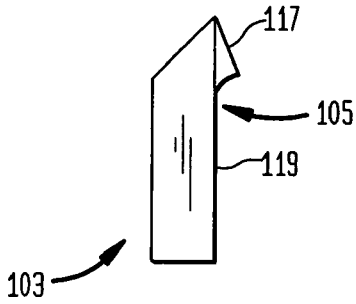
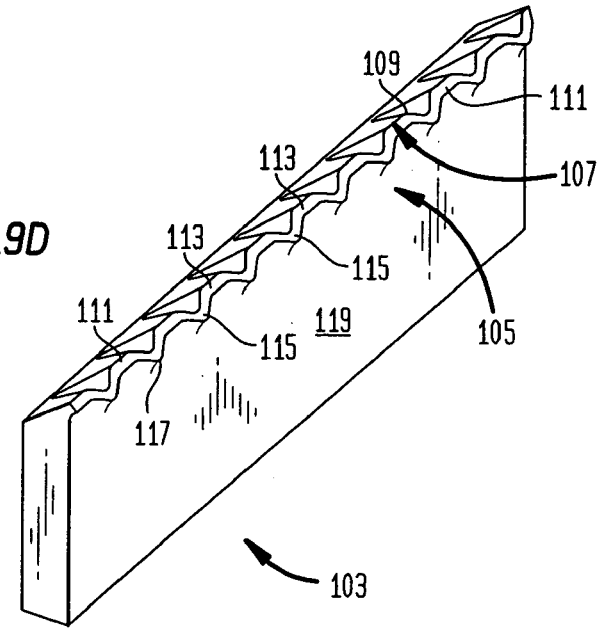
FIG. 19D
FIG. 19E
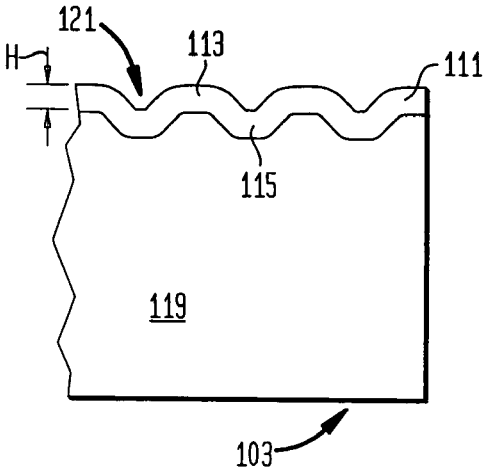

LOW COMPACTION, PNEUMATIC DEWATERING PROCESS FOR PRODUCING ABSORBENT SHEET

CLAIM FOR PRIORITY

This non-provisional application claims the benefit of the filing date of U.S. Provisional Patent Application Ser. No. 60/584,901 of the same title, filed Jul. 1, 2004.

TECHNICAL FIELD

The present invention relates generally to methods of making absorbent cellulosic sheet and more particularly to a method of making absorbent sheet by way of dewatering a cellulosic furnish on a forming fabric to form a nascent web, pneumatically dehydrating the web while avoiding channeling of the web by selection of one or more permeable distributor membranes followed by final drying or further processing of the web. The process provides premium absorbent products with a minimum of capital investment and operating costs. The process is readily adapted to existing facilities and amenable to making very high basis weight products useful as absorbent cores in multilayer products.

BACKGROUND

Methods of making paper tissue, towel, and the like are well known, including various features such as Yankee drying, throughdrying, fabric creping, dry creping, wet creping and so forth. Conventional wet pressing processes have certain advantages over conventional through-air drying processes including: (1) lower energy costs associated with the mechanical removal of water rather than transpiration drying with hot air; and (2) higher production speeds which are more readily achieved with processes which utilize wet pressing to form a web. On the other hand, through-air drying processing has been widely adopted for new capital investment, particularly for the production of soft, bulky, premium quality tissue and towel products.

Fabric creping has been employed in connection with papermaking processes as a means to influence product properties. See U.S. Pat. Nos. 4,689,119 and 4,551,199 of Weldon; U.S. Pat. Nos. 4,849,054 and 4,834,838 of Klowak; and U.S. Pat. No. 6,287,426 of Edwards et al. Operation of fabric creping processes wherein the creping is carried out at elevated web consistencies has been hampered by the difficulty of effectively transferring a web of high or intermediate consistency (30-60%) to a dryer. Note also U.S. Pat. No. 6,350,349 to Hermans et al. which discloses wet transfer of a web from a rotating transfer surface to a fabric. Further patents relating to fabric creping more generally including rush transfer or low consistency (i.e. 10-30%) fabric creping the following: U.S. Pat. Nos. 4,834,838; 4,482,429 4,445,638 as well as 4,440,597 to Wells et al. where rush transfer of a web at consistencies of about 10 to 30 percent is described.

Throughdried, creped products are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels which may be desired. Transfer to the Yankee typically takes place at web consistencies of from about 60% to about 70%.

As noted in the above, throughdried products tend to exhibit enhanced bulk and softness; however, thermal dewatering with hot air tends to be energy intensive and requires a relatively permeable web, such that recycle fiber is difficult to process in this manner. Wet-press operations wherein the webs are mechanically dewatered are preferable from an energy perspective and are more readily applied to furnishes containing recycle fiber which tends to form webs with less permeability than virgin fiber. Wet press/wet or dry crepe processes have been employed widely as is seen throughout the papermaking literature. Many improvements of wet-press processes relate to increasing the bulk and absorbency of compactively dewatered products.

As an alternative to conventional wet-press and through-drying processes, attempts have been made to incorporate air-pressing technology into papermaking machines. See, for example, the following patents of Hermans et al.; U.S. Pat. Nos. 6,497,789; 6,454,904; 6,096,169; and 6,083,346. Note, also, the following patents: U.S. Pat. Nos. 6,579,418; 6,318,727; 6,306,258; 6,306,257; 6,280,573; 6,338,220; 6,143,135; 6,093,284; and 6,080,279.

However, it is found that sealing of the press and/or channeling of the web limits the utility of proposed systems. Moreover, wet pressing in connection with air pressing during production may result in relatively dense webs unless great care is taken to avoid densification.

SUMMARY OF INVENTION

The present invention is directed to a process where a pressure chamber is formed by nip rolls and a distributor membrane and anti-rewet felt are selected to avoid channeling during pneumatic dewatering. Preparation of the web includes selecting an appropriate furnish and processing the nascent web so as to maintain high void volume fractions and relatively large hydraulic diameters as are seen in throughdried products. In one aspect, the present invention is directed to a low-compaction method of making an absorbent cellulosic web including the steps of: forming a nascent web from a papermaking furnish; dewatering the nascent web to a consistency of from about 10 to about 30 percent on a foraminous forming support traveling at a first speed; rush-transferring the web at a consistency of from 10 to about 30 percent to an open texture fabric traveling at a second speed slower than the first speed of the forming support; further dewatering the web on the open texture fabric to a consistency of from about 30 to about 60 percent by way of (i) combining the open texture fabric bearing said web with a fluid distribution membrane and an anti-rewet felt as the three pass through a nip into a pressure chamber defined in part by a plurality of nip rolls, the fluid distribution membrane bearing against the side of the open texture fabric away from the web, with the anti-rewet felt bearing against the web, and (ii) applying a pneumatic pressure gradient from the distributor membrane through the web thereby dewatering the web; and drying the web. The web is typically rush-transferred at a consistency of from about 15 to about 25 percent at a Rush Transfer Ratio of from about 10 percent to about 30 percent; preferably at a Rush Transfer Ratio of from about 15 percent to about 25 percent. The nascent web may be formed on a Fourdrinier former, wherein the nascent web is dewatered to a consistency of from about 20 percent to about 25 percent in the forming section.

In a preferred embodiment, the web is dewatered to a consistency of from about 45 to about 55 percent by application of pneumatic pressure across the web from the distributor membrane to the open texture fabric. The product, that is the dried web may have a CD stretch of from about 5 percent to about 20 percent, wherein some cases the dried web has a CD stretch of at least about 5 percent and an MD/CD tensile ratio of less than about 1.75; wherein others the dried web has a CD stretch of at least about 5 percent and an MD/CD tensile ratio of less than about 1.5; wherein still yet other embodiments the dried web has a CD stretch of at least about 10 percent and an MD/CD tensile ratio of less than about 2.5; wherein still further cases the dried web has a CD stretch of at least about 15 percent and an MD/CD tensile ratio of less than about 3.0; and wherein still other embodiments the dried web has a CD stretch of at least about 20 percent and an MD/CD tensile ratio of less than about 3.5. Still other attributes which may characterize the dried web in various embodiments are: a bulk of at least about 6 g/cc; a bulk of at least about 7.5 g/cc; a bulk of at least about 10 g/cc; a bulk of at least about 15 g/cc; an absorbency of at least 5 g/g; an absorbency of at least about 7 g/g; an absorbency of at least about 9 g/g; an absorbency of at least about 11 g/g; an absorbency of at least about 13 g/g; a void volume fraction of from about 0.7 to about 0.9; a void volume fraction of from about 0.75 to about 0.85; a Wet Springback Ratio of at least about 0.6; a Wet Springback Ratio of at least about 0.65; a Wet Springback Ratio of from about 0.6 to about 0.8; a void volume fraction of at least about 0.7 and a hydraulic diameter in the range of from about 1.5 microns to about 60 microns; a void volume fraction of at least about 0.7 and a hydraulic diameter in the range of from about 3 microns to about 20 microns; a basis weight of from about 30 to about 200 lbs per 3,000 square feet; and a basis weight of from about 100 to about 150 lbs per 3,000 square feet.

Another aspect of the invention is directed to a low-compaction method of making an absorbent cellulosic web comprising: forming a nascent web from a papermaking furnish; dewatering the nascent web to a consistency of from about 10 to about 30 percent on a foraminous forming support traveling at a first speed; rush-transferring the web at a consistency of from 10 to about 30 percent to an open texture fabric traveling at a second speed slower than the first speed of the forming support; further dewatering the web on the open texture fabric to a consistency of from about 30 to about 60 percent by way of: (i) combining the open texture fabric bearing said web with a fluid distribution membrane and an anti-rewet felt as the three pass through a nip into a pressure chamber defined in part by a plurality of nip rolls, the fluid distribution membrane bearing against the side of the open texture fabric away from the web, with the anti-rewet felt bearing against the web, and (ii) applying a pneumatic pressure gradient from the distributor membrane through the web thereby dewatering the web; and drying the web; drying the web; and selecting the papermaking furnish and controlling the process such that the dried web has a void volume fraction of at least 0.7, a hydraulic diameter in the range (preferably) of from about 3 to about 20 microns and a Wet Springback Ratio of at least about 0.65.

Yet another aspect of the invention is a low-compaction method of making an absorbent cellulosic web comprising: forming a nascent web from a papermaking furnish; dewatering the nascent web to a consistency of from about 10 to about 30 percent on a foraminous forming support traveling at a first speed; rush transferring the web to an open texture fabric; further dewatering the web on the open texture fabric to a consistency of from about 30 to about 60 percent by way of (i) combining the open texture fabric bearing said web with a fluid distribution membrane and an anti-rewet felt as the three pass through a nip into a pressure chamber defined in part by a plurality of nip rolls, the fluid distribution membrane bearing against the side of the open texture fabric away from the web, with the anti-rewet felt bearing against the web, and (ii) applying a pneumatic pressure gradient from the distributor membrane to through the web thereby dewatering the web; and drying the web while it is held in the open texture fabric to a consistency of at least about 90 percent. Typically, the web is dried while it is held in the impression fabric to a consistency of at least about 92 percent; preferably the web is dried while it is held in the open texture fabric to a consistency of at least about 95 percent. The web may be dried with a plurality of can dryers while held in the open texture fabric and/or the web is dried with an impingement-air dryer while held in the open texture fabric.

A further aspect of the invention is a low-compaction method of making an absorbent cellulosic web comprising: forming a nascent web from a papermaking furnish; dewatering the nascent web to a consistency of from about 10 to about 30 percent on a foraminous forming support traveling at a first speed; rush-transferring the web at a consistency of from about 10 to about 30 percent to an open texture fabric traveling at a second speed slower than the first a first of the forming support; further dewatering the web on the open texture fabric to a consistency of from about 30 to about 60 percent by way of (i) combining the open texture fabric bearing said web with a fluid distribution membrane and an anti-rewet felt as the three pass through a nip into a pressure chamber defined in part by a plurality of nip rolls, the fluid distribution membrane bearing against the side of the open texture fabric away from the web, with the anti-rewet felt bearing against the web, and (ii) applying a pneumatic pressure gradient from the distributor membrane through the web thereby dewatering the web; non-compactively transferring the web to a Yankee dryer; and drying the web. The web is preferably adhered to the Yankee with a polyvinyl alcohol creping adhesive as hereinafter described. The web may be creped from the Yankee dryer with an undulatory creping blade, or be way of a conventional creping blade.

Alternatively, the web is peeled from the Yankee without a creping blade.

A still further aspect of the invention is a method of making an absorbent cellulosic sheet comprising: forming a nascent web having an apparently random distribution of fiber orientation from a papermaking furnish; rush-transferring the web to an open texture fabric; drying the web to a consistency of from about 30 to about 60 percent by way of (i) combining the open texture fabric bearing said web with a fluid distribution membrane and an anti-rewet felt as the three pass through a nip into a pressure chamber defined in part by a plurality of nip rolls, the fluid distribution membrane bearing against the side of the open texture fabric away from the web, with the anti-rewet felt bearing against the web, and (ii) applying a pneumatic pressure gradient from the distributor membrane through the web thereby dewatering the web; thereafter transferring the web to a translating transfer surface moving at a first speed; fabric-creping the web from the transfer surface at a consistency of from about 30 to about 60 percent utilizing a creping fabric, the creping step occurring under pressure in a fabric creping nip defined between the transfer surface and the creping fabric wherein the fabric is traveling at a second speed slower than the speed of said transfer surface, the fabric pattern, nip parameters, velocity delta and web consistency being selected such that the web is creped from the surface and redistributed on the creping fabric to form a web with a reticulum having a plurality of interconnected regions of different fiber orientation including at least (i) a plurality of fiber enriched regions of having an orientation bias in a direction transverse to the machine-direction, interconnected by way of (ii) a plurality of colligating regions whose fiber orientation bias is offset from the fiber orientation of the fiber enriched regions; and drying the web. Typically, the web is fabric-creped from the transfer surface at a Fabric Crepe of from about 10 to about 100 percent; preferably the web is fabric-creped from the transfer surface at a Fabric Crepe of at least about 40 percent. In some cases the web is fabric-creped from the transfer surface at a Fabric Crepe of at least about 60 percent and in still others the web is fabric-creped from the transfer surface at a Fabric Crepe of at least about 80 percent. The transfer surface may be the surface of a rotating cylinder and the web may be applied to the rotating cylinder surface with a creping adhesive. Still other features and advantages of the invention will become apparent from the following description and appended drawings.

BRIEF DESCRIPTION OF DRAWINGS

The invention is described in detail below with reference to the drawings wherein like numerals designate similar parts and wherein:

FIG. 19B-19E are schematic diagrams illustrating the geometry of an undulatory creping blade utilized in accordance with the present invention;

DETAILED DESCRIPTION

Figure 1:
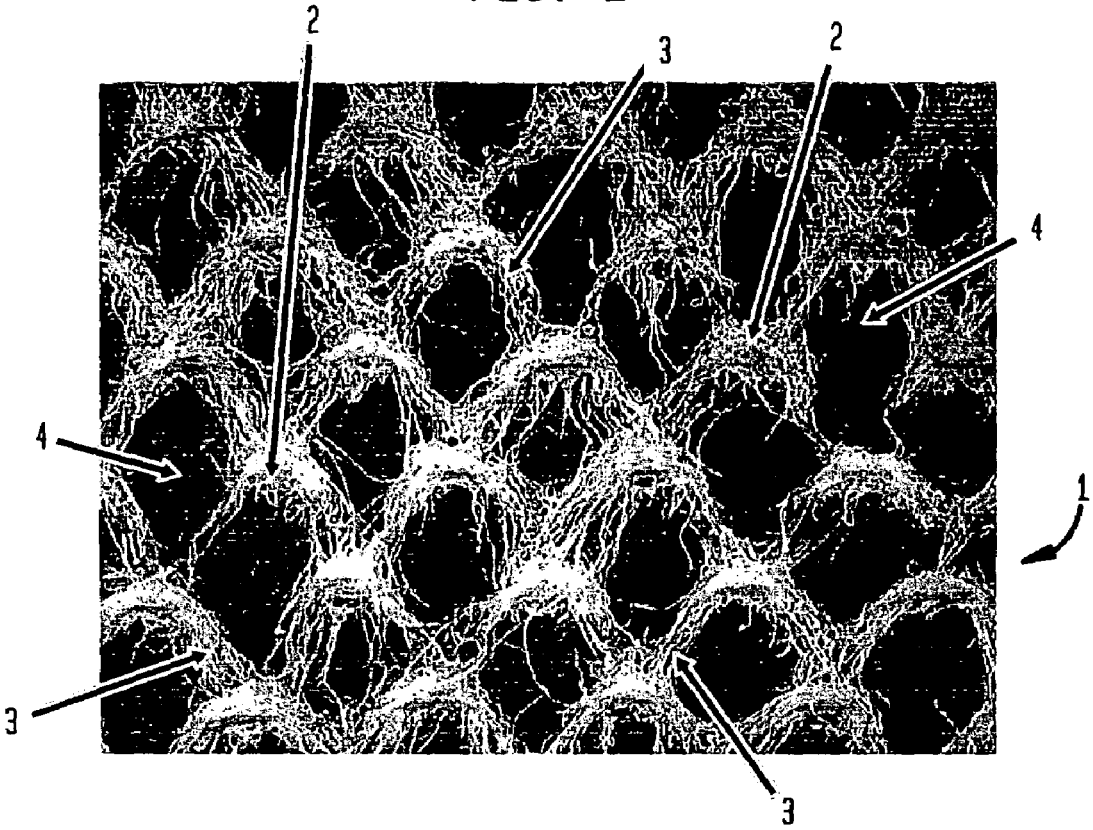
FIG. 1 is a photomicrograph (8×) of an open mesh web including a plurality of high basis weight regions linked by lower basis weight regions extending therebetween.

The invention is described below with reference to several embodiments. Such discussion is for purposes of illustration only. Modifications to particular examples within the spirit and scope of the present invention, set forth in the appended claims, will be readily apparent to one of skill in the art.

Terminology used herein is given its ordinary meaning and the definitions set forth immediately below, unless the context indicates otherwise.

Absorbency of the inventive products is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. Deionized water at 73° F. is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibation decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity also referred to as SAT is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow SAT" is specified in which case the cut off criteria is 1 mg in 20 seconds.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed, there may be a significant bias toward machine direction orientation making the machine direction tensile strength of the web exceed the cross-direction tensile strength.

Unless otherwise specified, "basis weight", BWT, bwt and so forth refers to the weight of a 3000 square foot ream of product. Consistency refers to percent solids of a nascent web, for example, calculated on a bone dry basis. "Air dry" means including residual moisture, by convention up to about 10 percent moisture for pulp and up to about 6% for paper. A nascent web having 50 percent water and 50 percent bone dry pulp has a consistency of 50 percent.

Calipers and or bulk reported herein may be measured 1, 4 or 8 sheet calipers as specified. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For testing in general, eight sheets are selected and stacked together. For napkin testing, napkins are unfolded prior to stacking. For basesheet testing off of winders, each sheet to be tested must have the same number of plies as produced off the winder. For basesheet testing off of the paper machine reel, single plies must be used. Sheets are stacked together aligned in the MD. On custom embossed or printed product, try to avoid taking measurements in these areas if at all possible. Bulk may also be expressed in units of volume/weight by dividing caliper by basis weight.

The term "cellulosic", "cellulosic sheet" and the like is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, optionally wet strength resins, debonders and the like for making paper products.

Creping fabric and like terminology refers to a fabric or belt which bears a pattern suitable for practicing the process of the present invention and preferably is permeable enough such that the web may be dried while it is held in the creping fabric. In cases where the web is transferred to another fabric or surface (other than the creping fabric) for drying, the creping fabric may have lower permeability.

"Fabric side" and like terminology refers to the side of the web which is in contact with the creping and drying fabric. "Dryer side" or "can side" is the side of the web opposite the fabric side of the web.

Fabric Crepe Ratio is an expression of the speed differential between a creping belt or fabric and the transfer cylinder or surface and is defined as the ratio of the web speed immediately before creping and the web speed immediately following creping, for example:

Fabric Crepe Ratio=Transfer cylinder speed÷Creping fabric speed

Fabric Crepe can also be expressed as a percentage calculated as:

Fabric Crepe, percent,=Fabric Crepe Ratio−1×100%.

A web creped from a transfer cylinder with a surface speed of 750 fpm to a fabric with a velocity of 500 fpm has a fabric crepe ratio of 1.5 and a fabric crepe of 50%.

Similarly,

Rush Transfer Ratio=donor fabric speed÷receiving fabric speed.

Rush Transfer Ratio, percent=(Rush Transfer Ratio−1)×100%.

Fpm refers to feet per minute.

During fabric creping in a pressure nip, the fiber is redistributed on the fabric, making the process tolerant of less than ideal forming conditions, as are sometimes seen with a Fourdrinier former. The forming section of a Fourdrinier machine includes two major parts, the headbox and the Fourdrinier Table. The latter consists of the wire run over the various drainage-controlling devices. The actual forming occurs along the Fourdrinier Table. The hydrodynamic effects of drainage, oriented shear, and turbulence generated along the table are generally the controlling factors in the forming process. Of course, the headbox also has an important influence in the process, usually on a scale that is much larger than the structural elements of the paper web. Thus the headbox may cause such large-scale effects as variations in distribution of flow rates, velocities, and concentrations across the full width of the machine; vortex streaks generated ahead of and aligned in the machine direction by the accelerating flow in the approach to the slice; and time-varying surges or pulsations of flow to the headbox. The existence of MD-aligned vortices in headbox discharges is common. Fourdrinier formers are further described in *The Sheet Forming Process*, Parker, J. D., Ed., TAPPI Press (1972, reissued 1994) Atlanta, Ga.

MD means machine direction and CD means cross-machine direction.

Nip parameters include, without limitation, nip pressure, nip length, backing roll hardness, fabric approach angle, fabric takeaway angle, uniformity, and velocity delta between surfaces of the nip. Nip length means the length over which the nip surfaces are in contact.

The terminology "non-compactively" transferring the web to a Yankee dryer or other surface refers to transfers where the web is not compressed over substantially its entire surface as is the case when a wet web is applied to a Yankee from a wet press felt using a suction roll and pressure nip for purposes of dewatering the web. Localized compression or shaping by fabric knuckles does not substantially dewater the web or cause overall compaction. Accordingly, such a transfer from an open texture fabric to a cylinder surface is non-compactive in nature.

Open texture fabrics and like terminology means fabrics with substantial open area and texture such as impression fabrics and dryer fabrics described hereinafter.

PLI or pli means pounds force per linear inch.

"Predominant" and like terminology as applied to a component of a composition means that such component is at least 50 percent by weight of that composition based on active ingredient. Water content of an aqueous composition is excluded.

Pusey and Jones (P&J) hardness (indentation) is measured in accordance with ASTM D 531, and refers to the indentation number (standard specimen and conditions).

Dry tensile strengths (MD and CD), stretch, ratios thereof, modulus, break modulus, stress and strain are measured with a standard Instron test device or other suitable elongation tensile tester which may be configured in various ways, typically using 3 or 1 inch wide strips of tissue or towel, conditioned in an atmosphere of 23°±1° C. (73.4°±1° F.) at 50% relative humidity for 2 hours. The tensile test is run at a crosshead speed of 2 in/min. Modulus is expressed in lbs/inch per inch of elongation unless otherwise indicated.

Tensile ratios are simply ratios of the values determined by way of the foregoing methods. Unless otherwise specified, a tensile property is a dry sheet property.

A translating transfer surface refers to the surface from which the web is creped into the creping fabric. The translating transfer surface may be the surface of a rotating drum as described hereafter, or may be the surface of a continuous smooth moving belt or another moving fabric which may have surface texture and so forth. The translating transfer surface needs to support the web and facilitate the high solids creping as will be appreciated from the discussion which follows.

Velocity delta means a difference in speed.

The void volume and/or void volume ratio as referred to hereafter, are determined by saturating a sheet with a nonpolar POROFIL® liquid and measuring the amount of liquid absorbed. The volume of liquid absorbed is equivalent to the void volume within the sheet structure. The percent weight increase (PWI) is expressed as grams of liquid absorbed per gram of fiber in the sheet structure times 100, as noted hereinafter. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. To measure absorbency, weigh and record the dry weight of each test specimen to the nearest 0.0001 gram. Place the specimen in a dish containing POROFIL® liquid having a specific gravity of 1.875 grams per cubic centimeter, available from Coulter Electronics Ltd., Northwell Drive, Luton, Beds, England; Part No. 9902458. ) After 10 seconds, grasp the specimen at the very edge (1-2 Millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL® liquid per gram of fiber, is calculated as follows:

$$PWI=[(W_2-W_1)/W_1]\times 100\%$$

wherein

"$W_1$" is the dry weight of the specimen, in grams; and

"$W_2$" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm) is simply the weight increase ratio; that is, PWI divided by 100. The dimensionless void volume fraction and/or void volume percent is readily calculated from the void volume in grams/gm by calculating the relative volumes of fluid and fiber determined by the foregoing procedure, i.e., the void volume fraction is the volume of Porofil® liquid absorbed by the sheet divided by the volume of fibrous material plus the volume of Porofil liquid absorbed (total volume) or in equation form:

$$\text{void volume fraction} = \frac{\text{(void volume}\times\text{specific volume of fluid)}}{\left(\text{void volume}\times\text{specific volume of fluid}+\text{specific volume of fiber}\right)} = \frac{\text{void volume}\times 0.533}{\text{(void volume}\times 0.533+\text{specific volume of fiber)}}$$

Unless otherwise indicated, the specific volume of fiber is taken as unity. Thus a product having a void volume of 6 grams/gm has a void volume fraction of 3.2/4.2 or 0.76 and a void volume in percent of 76% as that terminology is used herein.

The products and processes of the present invention are advantageously practiced with cellulosic fiber as the predominant constituent fiber in the furnishes and products, generally greater than 75% by weight and typically greater than 90% by weight of the product. Nevertheless, as one of skill in the art will appreciate, the invention may be practiced with other suitable furnishes.

Preferred products of the invention are characterized by relatively high hydraulic diameters derived from the Reynolds Number characterizing flow through the sheet. Reynolds Number for air flow through the fibrous cellulosic sheet can be inferred from its definition as the ratio of inertial to viscous forces at a point in the flow:

$$N_{Re} = \frac{\text{Inertia_force}}{\text{Viscous_force}} = \frac{\beta\rho V}{\alpha\mu} = \frac{(\beta/\alpha)\rho V}{\mu} = \frac{(\beta/\alpha)G}{\mu}$$

where $\beta/\alpha$ the hydraulic diameter, whose measure is length, is understood to characterize the geometry of the flow through the interstices of the sheet.

The parameters $\alpha$ and $\beta$ can best be determined from the experimental data if a new variable $\phi$ is defined as:

$$\varphi = \frac{Mg_c}{2RTG}\cdot\frac{\Delta P^2}{L} = \alpha\mu + \beta G$$

Clearly $\phi$ is observed to be linearly dependent upon G, the mass velocity; further, $\alpha$ and $\beta$ are related to the intercept and slope of the ($\phi$, G) plot. Moreover, only two sets of values of $\phi$ and G are necessary to establish the linear relation.

In engineering units, $\phi$ may be calculated as:

$$\varphi = \frac{Mg_c}{2GRT_1}\cdot\frac{P_1^2-P_2^2}{L} = \alpha\mu + \beta G$$

where:
M = 28.964 lbm/lbmole*
$g_c$ = 32.174 ft-lbm/lbf sec2
upstream pressure, $P_1$ = 2116.2 lbf/ft2*
sheet thickness, L = 7.29 × $10^{-4}$ ft
R = 1545 ft-lbf/lbmol-DegR
$T_1$ = 518.67 DegR*
$\rho$ = 0.07647 lbm/ft @ patm & $T_1$*
$\mu$ = 1.203 × $10^{-5}$ lbm/ft. sec*
*International Standard Atmosphere

TABLE 1

Sample Calculation of Hydraulic Properties

| dP | V lb/ft$^2$ | Downstream pressure, $P_2$ fps | G lbf/ft$^2$ | ϕ Value lbm/sqft-sec | Lbm/ft$^3$-sec |
|---|---|---|---|---|---|
| | 31.1818 | 5.93 | 2085.0 | 0.4505 | 231889 |
| | 41.5757 | 7.45 | 2074.6 | 0.5642 | 246242 |
| | 51.9696 | 8.80 | 2064.3 | 0.6648 | 260582 |
| | 62.3635 | 10.10 | 2053.9 | 0.7612 | 272450 |
| | 72.7574 | 11.42 | 2043.5 | 0.8582 | 281201 |
| | 83.1514 | 12.77 | 2033.1 | 0.9573 | 287389 |
| | 93.5453 | 13.95 | 2022.7 | 1.0434 | 295887 |
| | 103.939 | 15.14 | 2012.3 | 1.1297 | 302889 |
| | | | | Slope: | 103079.8 |
| | | | | Intercept: | 189472.6 |

$\alpha$ = Intercept/$\mu$ $\alpha$(ft$^{-2}$): $1.575 \times 10^{10}$
$\beta$ = slope $\beta$(ft$^{-1}$): $1.031 \times 10^{5}$
Hydraulic diameter (HD) $\beta/\alpha$(ft): $6.544 \times 10^{-6}$
[1]4% aqueous solution, 20° C.

Further detail may be found in co-pending U.S. patent application Ser. No. 10/042,513, entitled Wet Crepe Throughdry Process for Making Absorbent Sheet and Products Thereof.

The products of the present invention exhibit wet resiliency which is manifested in wet compressive recovery tests. A particularly convenient measure is Wet Springback Ratio which measures the ability of the product to elastically recover from compression. For measuring this parameter, each test specimen is prepared to consist of a stack of two or more conditioned (24 hours @ 50% RH, 73° F. (23° C.)) dry sample sheets cut to 2.5" (6.4 cm) squares, providing a stack mass preferably between 0.2 and 0.6 g. The test sequence begins with the treatment of the dry sample. Moisture is applied uniformly to the sample using a fine mist of deionized water to bring the moisture ratio (g water/g dry fiber) to approximately 1.1. This is done by applying 95-110% added moisture, based on the conditioned sample mass. This puts typical cellulosic materials in a moisture range where physical properties are relatively insensitive to moisture content (e.g., the sensitivity is much less than it is for moisture ratios less than 70%). The moistened sample is then placed in the test device. A programmable strength measurement device is used in compression mode to impart a specified series of compression cycles to the sample. Initial compression of the sample to 0.025 psi (0.172 kPa) provides an initial thickness (cycle A), after which two repetitions of loading up to 2 psi (13.8 kPa) are followed by unloading (cycles B and C). Finally, the sample is again compressed to 0.025 psi (0.172 kPa) to obtain a final thickness (cycle D). (Details of this procedure, including compression speeds, are given below).

Three measures of wet resiliency may be considered which are relatively insensitive to the number of sample layers used in the stack. The first measure is the bulk of the wet sample at 2 psi (13.8 kPa). This is referred to as the "Compressed Bulk". The second measure (more pertinent to the following examples) is termed "Wet Springback Ratio", which is the ratio of the moist sample thickness at 0.025 psi (0.172 kPa) at the end of the compression test (cycle D) to the thickness of the moist sample at 0.025 psi (0.172 kPa) measured at the beginning of the test (cycle A). The third measure is the "Loading Energy Ratio", which is the ratio of loading energy in the second compression to 2 psi (13.8 kPa) (cycle C) to that of the first compression to 2 psi (13.8 kPa) (cycle B) during the sequence described above, for a wetted sample. When load is plotted as a function of thickness, Loading Energy is the area under the curve as the sample goes from an unloaded state to the peak load of that cycle. For a purely elastic material, the spingback and loading energy ratio would be unity. The three measures described are relatively independent of the number of layers in the stack and serve as useful measures of wet resiliency. One may also refer to the Compression Ratio, which is defined as the ratio of moistened sample thickness at peak load in the first compression cycle to 2 psi (13.8 kPa) to the initial moistened thickness at 0.025 psi (0.172 kPa).

In carrying out the measurements of the wet compression recovery, samples should be conditioned for at least 24 hours under TAPPI conditions (50% RH, 73° F. (23° C.)). Specimens are die cut to 2.5"×2.5" (6.4×6.4 cm) squares. Conditioned sample weight should be near 0.4 g, if possible, and within the range of 0.25 to 0.6 g for meaningful comparisons. The target mass of 0.4 g is achieved by using a stack of 2 or more sheets if the sheet basis weight is less than 65 gsm. For example, for nominal 30 gsm sheets, a stack of 3 sheets will generally be near 0.4 g total mass.

Compression measurements are performed using an Instron (RTM) 4502 Universal Testing Machine interfaced with a 826 PC computer running Instron (RTM) Series XII software (1989 issue) and Version 2 firmware. A 100 kN load cell is used with 2.25" (5.72 cm) diameter circular platens for sample compression. The lower platen has a ball bearing assembly to allow exact alignment of the platens. The lower platen is locked in place while under load (30-100 lbf) (130-445 N) by the upper platen to ensure parallel surfaces. The upper platen must also be locked in place with the standard ring nut to eliminate play in the upper platen as load is applied.

Following at least one hour of warm-up after start-up, the instrument control panel is used to set the extensiometer to zero distance while the platens are in contact (at a load of 10-30 lb (4.5-13.6 kg)). With the upper platen freely suspended, the calibrated load cell is balanced to give a zero reading. The extensiometer and load cell; should be periodically checked to prevent baseline drift (shifting of the zero points). Measurements must be performed in a controlled humidity and temperature environment, according to TAPPI specifications (50%±2% RH and 73° F. (23° C.)). The upper platen is then raised to a height of 0.2 in. and control of the Instron is transferred to the computer.

Using the Instron Series XII Cyclic Test software, an instrument sequence is established with 7 markers (discrete events) composed of 3 cyclic blocks (instructions sets) in the following order:

| | |
|---|---|
| Marker 1: | Block 1 |
| Marker 2: | Block 2 |
| Marker 3: | Block 3 |
| Marker 4: | Block 2 |
| Marker 5: | Block 3 |
| Marker 6: | Block 1 |
| Marker 7: | Block 3. |

Block 1 instructs the crosshead to descend at 1.5 in./min (3.8 cm/min) until a load of 0.1 lb (45 g) is applied (the Instron setting is −0.1 lb (−45 g), since compression is defined as negative force). Control is by displacement. When the targeted load is reached, the applied load is reduced to zero.

Block 2 directs that the crosshead range from an applied load of 0.05 lb (23 g) to a peak of 8 lb (3.6 kg) then back to 0.05 lb (23 g) at a speed of 0.4 in./min. (1.02 cm/min). Using the Instron software, the control mode is displacement, the limit type is load, the first level is −0.05 lb (−23 g), the second level is −8 lb (−3.6 kg), the dwell time is 0 sec., and the number of transitions is 2 (compression, then relaxation); "no action" is specified for the end of the block.

Block 3 uses displacement control and limit type to simply raise the crosshead to 0.2 in (0.51 cm) at a speed of 4 in./min. (10.2 cm/min), with 0 dwell time. Other Instron software settings are 0 in first level, 0.2 in (0.51 cm) second level, 1 transition, and "no action" at the end of the block.

When executed in the order given above (Markers 1-7), the Instron sequence compresses the sample to 0.025 psi (0.1 lbf) [0.172 kPa (0.44 N)], relaxes, then compresses to 2 psi (8 lbs) [13.8 kPa (3.6 Kg)], followed by decompression and a crosshead rise to 0.2 in (0.51 cm), then compresses the sample again to 2 psi (13.8 kPa), relaxes, lifts the crosshead to 0.2 in. (0.51 cm), compresses again to 0.025 psi (0.1 lbf) [0.172 kPa (0.44 N)], and then raises the crosshead. Data logging should be performed at intervals no greater than every 0.02" (0.051 cm) or 0.4 lb (180 g), (whichever comes first) for Block 2 and for intervals no greater than 0.01 lb (4.5 g) for Block 1. Preferably, data logging is performed every 0.004 lb (1.8 g) in Block 1 and every 0.05 lb. (23 g) or 0.005 in. (0.13 mm) (whichever comes first) in Block 2.

The results output of the Series XII software is set to provide extension (thickness) at peak loads for Markers 1, 2, 4 and 6 (at each 0.025 (0.172 kPa) and 2.0 psi (13.8 kPa) peak load), the loading energy for Markers 2 and 4 (the two compressions to 2.0 psi (13.8 kPa) previously termed cycles B and C, respectively), and the ratio of final thickness to initial thickness (ratio of thickness at last to first 0.025 psi (0.172 kPa) compression). Load versus thickness results are plotted on the screen during execution of Blocks 1 and 2.

In performing a measurement, the dry, conditioned sample moistened (deionized water at 72-73° F. (22.2-22.8° C.) is applied.). Moisture is applied uniformly with a fine mist to reach a moist sample mass of approximately 2.0 times the initial sample mass (95-110% added moisture is applied, preferably 100% added moisture, based on conditioned sample mass; this level of moisture should yield an absolute moisture ratio between 1.1 and 1.3 g. water/g. oven dry fiber—with oven dry referring to drying for at least 30 minutes in an oven at 105° C.). The mist should be applied uniformly to separated sheets (for stacks of more than 1 sheet), with spray applied to both front and back of each sheet to ensure uniform moisture application. This can be achieved using a conventional plastic spray bottle, with a container or other barrier blocking most of the spray, allowing only about the upper 10-20% of the spray envelope—a fine mist—to approach the sample. The spray source should be at least 10" away from the sample during spray application. In general, care must be applied to ensure that the sample is uniformly moistened by a fine spray. The sample must be weighed several times during the process of applying moisture to reach the targeted moisture content. No more than three minutes should elapse between the completion of the compression tests on the dry sample and the completion of moisture application. Allow 45-60 seconds from the final application of spray to the beginning of the subsequent compression test to provide time for internal wicking and absorption of the spray. Between three and four minutes will elapse between the completion of the dry compression sequence and initiation of the wet compression sequence.

Once the desired mass range has been reached, as indicated by a digital balance, the sample is centered on the lower Instron platen and the test sequence is initiated. Following the measurement, the sample is placed in a 105° C. oven for drying, and the oven dry weight will be recorded later (sample should be allowed to dry for 30-60 minutes, after which the dry weight is measured).

Creep recovery can occur between the two compression cycles to 2 psi (13.8 kPa), so the time between the cycles may be important. For the instrument settings used in these Instron tests, there is a 30 second period (±4 sec.) between the beginning of compression during the two cycles to 2 psi (13.8 kPa). The beginning of compression is defined as the point at which the load cell reading exceeds 0.03 lb. (13.6 g). Likewise, there is a 5-8 second interval between the beginning of compression in the first thickness measurement (ramp to 0.025 psi (0.172 kPa)) and the beginning of the subsequent compression cycle to 2 psi (13.8 kPa)). The interval between the beginning of the second compression cycle to 2 psi (13.8 kPa) and the beginning of compression for the final thickness measurement is approximately 20 seconds.

A creping adhesive is optionally used to secure the web to the transfer cylinder hereinafter described. The adhesive is preferably a hygroscopic, rewettable, substantially non-crosslinking adhesive. Examples of preferred adhesives are those which include poly(vinyl alcohol) of the general class described in U.S. Pat. No. 4,528,316 to Soerens et al. Other suitable adhesives are disclosed in co-pending U.S. Provisional Patent Application Ser. No. 60/372,255, filed Apr. 12, 2002, entitled "Improved Creping Adhesive Modifier and Process for Producing Paper Products" The disclosures of the '316 patent and the '255 application are incorporated herein by reference. Suitable adhesives are optionally provided with modifiers and so forth. It is preferred to use crosslinker sparingly or not at all in the adhesive in many cases; such that the resin is substantially non-crosslinkable in use.

Creping adhesives may comprise a thermosetting or non-thermosetting resin, a film-forming semi-crystalline polymer and optionally an inorganic cross-linking agent as well as modifiers. Optionally, the creping adhesive of the present invention may also include any art-recognized components, including, but not limited to, organic cross linkers, hydrocarbons oils, surfactants, or plasticizers.

Creping modifiers which may be used include a quaternary ammonium complex comprising at least one non-cyclic amide. The quaternary ammonium complex may also contain one or several nitrogen atoms (or other atoms) that are capable of reacting with alkylating or quaternizing agents. These alkylating or quaternizing agents may contain zero, one, two, three or four non-cyclic amide containing groups. An amide containing group is represented by the following formula structure:

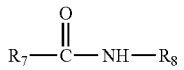

where $R_7$ and $R_8$ are non-cyclic molecular chains of organic or inorganic atoms.

Preferred non-cyclic bis-amide quaternary ammonium complexes can be of the formula:

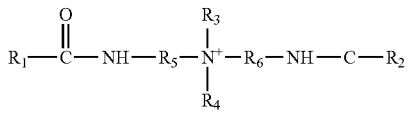

where $R_1$ and $R_2$ can be long chain non-cyclic saturated or unsaturated aliphatic groups; $R_3$ and $R_4$ can be long chain non-cyclic saturated or unsaturated aliphatic groups, a halogen, a hydroxide, an alkoxylated fatty acid, an alkoxylated fatty alcohol, a polyethylene oxide group, or an organic alcohol group; and $R_5$ and $R_6$ can be long chain non-cyclic saturated or unsaturated aliphatic groups. The modifier is present in the creping adhesive in an amount of from about 0.05% to about 50%, more preferably from about 0.25% to about 20%, and most preferably from about 1% to about 18% based on the total solids of the creping adhesive composition.

Modifiers include those obtainable from Goldschmidt Corporation of Essen/Germany or Process Application Corporation based in Washington Crossing, Pa. Appropriate creping modifiers from Goldschmidt Corporation include, but are not limited to, VARISOFT® 222LM, VARISOFT® 222, VARISOFT® 110, VARISOFT® 222LT, VARISOFT® 110 DEG, and VARISOFT® 238. Appropriate creping modifiers from Process Application Corporation include, but are not limited to, PALSOFT 580 FDA or PALSOFT 580C.

Other creping modifiers for use in the present invention include, but are not limited to, those compounds as described in WO/01/85109, which is incorporated herein by reference in its entirety.

Creping adhesives for use in connection with to the present invention may include any suitable thermosetting or non-thermosetting resin. Resins according to the present invention are preferably chosen from thermosetting and non-thermosetting polyamide resins or glyoxylated polyacrylamide resins. Polyamides for use in the present invention can be branched or unbranched, saturated or unsaturated.

Polyamide resins for use in the present invention may include polyaminoamide-epichlorohydrin (PAE) resins of the same general type employed as wet strength resins. PAE resins are described, for example, in "Wet-Strength Resins and Their Applications," Ch. 2, H. Epsy entitled Alkaline-Curing Polymeric Amine-Epichlorohydrin Resins, which is incorporated herein by reference in its entirety. Preferred PAE resins for use according to the present invention include a water-soluble polymeric reaction product of an epihalohydrin, preferably epichlorohydrin, and a water-soluble polyamide having secondary amine groups derived from a polyalkylene polyamine and a saturated aliphatic dibasic carboxylic acid containing from about 3 to about 10 carbon atoms.

A non-exhaustive list of non-thermosetting cationic polyamide resins can be found in U.S. Pat. No. 5,338,807, issued to Espy et al. and incorporated herein by reference. The non-thermosetting resin may be synthesized by directly reacting the polyamides of a dicarboxylic acid and methyl bis(3-aminopropyl)amine in an aqueous solution, with epichlorohydrin. The carboxylic acids can include saturated and unsaturated dicarboxylic acids having from about 2 to 12 carbon atoms, including for example, oxalic, malonic, succinic, glutaric, adipic, pilemic, suberic, azelaic, sebacic, maleic, itaconic, phthalic, and terephthalic acids. Adipic and glutaric acids are preferred, with adipic acid being the most preferred. The esters of the aliphatic dicarboxylic acids and aromatic dicarboxylic acids, such as the phathalic acid, may be used, as well as combinations of such dicarboxylic acids or esters.

Thermosetting polyamide resins for use in the present invention may be made from the reaction product of an epihalohydrin resin and a polyamide containing secondary amine or tertiary amines. In the preparation of such a resin, a dibasic carboxylic acid is first reacted with the polyalkylene polyamine, optionally in aqueous solution, under conditions suitable to produce a water-soluble polyamide. The preparation of the resin is completed by reacting the water-soluble amide with an epihalohydrin, particularly epichlorohydrin, to form the water-soluble thermosetting resin.

The of preparation of water soluble, thermosetting polyamide-epihalohydrin resin is described in U.S. Pat. Nos. 2,926,116; 3,058,873; and 3,772,076 issued to Kiem, all of which are incorporated herein by reference in their entirety.

The polyamide resin may be based on DETA instead of a generalized polyamine. Two examples of structures of such a polyamide resin are given below. Structure 1 shows two types of end groups: a di-acid and a mono-acid based group:

STRUCTURE 1

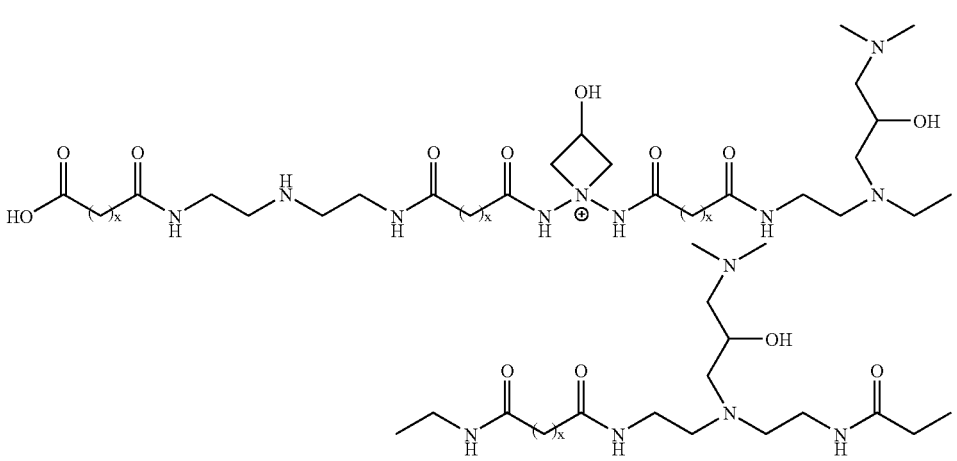

Structure 2 shows a polymer with one end-group based on a di-acid group and the other end-group based on a nitrogen group:

STRUCTURE 2

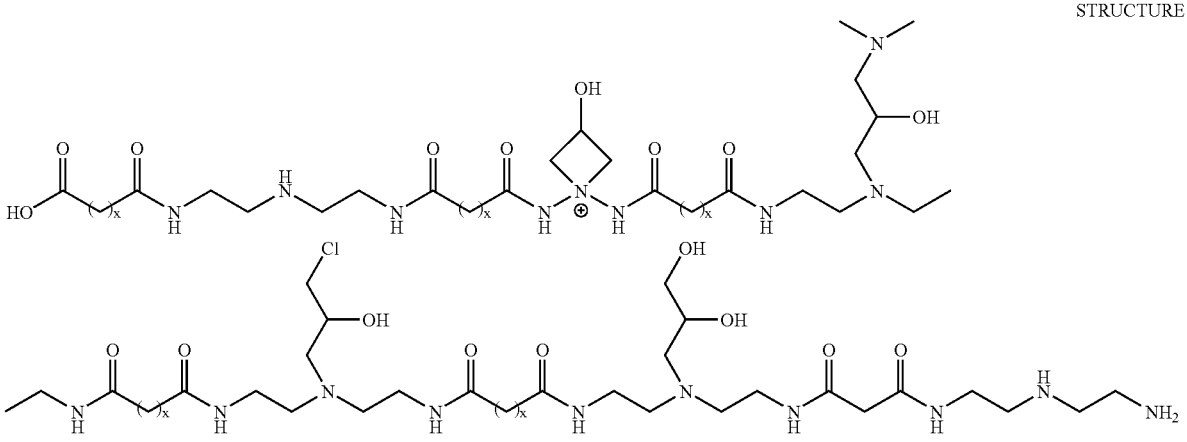

Note that although both structures are based on DETA, other polyamines may be used to form this polymer, including those, which may have tertiary amide side chains.

The polyamide resin has a viscosity of from about 80 to about 800 centipoise and a total solids of from about 5% to about 40%. The polyamide resin is present in the creping adhesive according to the present invention in an amount of from about 0% to about 99.5%. According to another embodiment, the polyamide resin is present in the creping adhesive in an amount of from about 20% to about 80%. In yet another embodiment, the polyamide resin is present in the creping adhesive in an amount of from about 40% to about 60% based on the total solids of the creping adhesive composition.

Polyamide resins for use according to the present invention can be obtained from Ondeo-Nalco Corporation, based in Naperville, Ill., and Hercules Corporation, based in Wilmington, Del. Creping adhesive resins for use according to the present invention from Ondeo-Nalco Corporation include, but are not limited to, CREPECCEL® 675NT, CREPECCEL® 675P and CREPECCEL® 690HA. Appropriate creping adhesive resins available from Hercules Corporation include, but are not limited to, HERCULES 82-176, Unisoft 805 and CREPETROL A-6115.

Other polyamide resins for use according to the present invention include, for example, those described in U.S. Pat. Nos. 5,961,782 and 6,133,405, both of which are incorporated herein by reference.

The creping adhesive may also comprise a film-forming semi-crystalline polymer. Film-forming semi-crystalline polymers for use in the present invention can be selected from, for example, hemicellulose, carboxymethyl cellulose, and most preferably includes polyvinyl alcohol (PVOH). Polyvinyl alcohols used in the creping adhesive can have an average molecular weight of about 13,000 to about 124,000 daltons. According to one embodiment, the polyvinyl alcohols have a degree of hydrolysis of from about 80% to about 99.9%. According to another embodiment, polyvinyl alcohols have a degree of hydrolysis of from about 85% to about 95%. In yet another embodiment, polyvinyl alcohols have a degrees of hydrolysis of from about 86% to about 90%. Also, according to one embodiment, polyvinyl alcohols preferably have a viscosity, measured at 20 degree centigrade using a 4% aqueous solution, of from about 2 to about 100 centipoise. According to another embodiment, polyvinyl alcohols have a viscosity of from about 10 to about 70 centipoise. In yet another embodiment, polyvinyl alcohols have a viscosity of from about 20 to about 50 centipoise.

Typically, the polyvinyl alcohol is present in the creping adhesive in an amount of from about 10% to 90% or 20% to about 80% or more. In some embodiments, the polyvinyl alcohol is present in the creping adhesive in an amount of from about 40% to about 60%, by weight, based on the total solids of the creping adhesive composition.

Polyvinyl alcohols for use according to the present invention include those obtainable from Monsanto Chemical Co. and Celanese Chemical. Appropriate polyvinyl alcohols from Monsanto Chemical Co. include Gelvatols, including, but not limited to, GELVATOL 1-90, GELVATOL 3-60, GELVATOL 20-30, GELVATOL 1-30, GELVATOL 20-90, and GELVATOL 20-60. Regarding the Gelvatols, the first number indicates the percentage residual polyvinyl acetate and the next series of digits when multiplied by 1,000 gives the number corresponding to the average molecular weight.

Celanese Chemical polyvinyl alcohol products for use in the creping adhesive (previously named Airvol products from Air Products until October 2000) are listed below:

TABLE 2

Polyvinyl Alcohol for Creping Adhesive

| Grade | % Hydrolysis, | Viscosity, cps[1] | pH | Volatiles, % Max. | Ash, % Max.[3] |
|---|---|---|---|---|---|
| | | Super Hydrolyzed | | | |
| Celvol 125 | 99.3+ | 28-32 | 5.5-7.5 | 5 | 1.2 |
| Celvol 165 | 99.3+ | 62-72 | 5.5-7.5 | 5 | 1.2 |

TABLE 2-continued

| Polyvinyl Alcohol for Creping Adhesive | | | | | |
|---|---|---|---|---|---|
| Grade | % Hydrolysis, | Viscosity, cps[1] | pH | Volatiles, % Max. | Ash, % Max.[3] |
| | | Fully Hydrolyzed | | | |
| Celvol 103 | 98.0-98.8 | 3.5-4.5 | 5.0-7.0 | 5 | 1.2 |
| Celvol 305 | 98.0-98.8 | 4.5-5.5 | 5.0-7.0 | 5 | 1.2 |
| Celvol 107 | 98.0-98.8 | 5.5-6.6 | 5.0-7.0 | 5 | 1.2 |
| Celvol 310 | 98.0-98.8 | 9.0-11.0 | 5.0-7.0 | 5 | 1.2 |
| Celvol 325 | 98.0-98.8 | 28.0-32.0 | 5.0-7.0 | 5 | 1.2 |
| Celvol 350 | 98.0-98.8 | 62-72 | 5.0-7.0 | 5 | 1.2 |
| | | Intermediate Hydrolyzed | | | |
| Celvol 418 | 91.0-93.0 | 14.5-19.5 | 4.5-7.0 | 5 | 0.9 |
| Celvol 425 | 95.5-96.5 | 27-31 | 4.5-6.5 | 5 | 0.9 |
| | | Partially Hydrolyzed | | | |
| Celvol 502 | 87.0-89.0 | 3.0-3.7 | 4.5-6.5 | 5 | 0.9 |
| Celvol 203 | 87.0-89.0 | 3.5-4.5 | 4.5-6.5 | 5 | 0.9 |
| Celvol 205 | 87.0-89.0 | 5.2-6.2 | 4.5-6.5 | 5 | 0.7 |
| Celvol 513 | 86.0-89.0 | 13-15 | 4.5-6.5 | 5 | 0.7 |
| Celvol 523 | 87.0-89.0 | 23-27 | 4.0-6.0 | 5 | 0.5 |
| Celvol 540 | 87.0-89.0 | 45-55 | 4.0-6.0 | 5 | 0.5 |

[1]4% aqueous solution, 20° C.

The creping adhesive may also comprise one or more inorganic cross-linking salts or agents. Such additives are believed best used sparingly or not at all in connection with the present invention. A non-exhaustive list of multivalent metal ions includes calcium, barium, titanium, chromium, manganese, iron, cobalt, nickel, zinc, molybdenum, tin, antimony, niobium, vanadium, tungsten, selenium, and zirconium. Mixtures of metal ions can be used. Preferred anions include acetate, formate, hydroxide, carbonate, chloride, bromide, iodide, sulfate, tartrate, and phosphate. An example of a preferred inorganic cross-linking salt is a zirconium salt. The zirconium salt for use according to one embodiment of the present invention can be chosen from one or more zirconium compounds having a valence of plus four, such as ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate. Appropriate zirconium compounds include, for example, those described in U.S. Pat. No. 6,207,011, which is incorporated herein by reference.

The inorganic cross-linking salt can be present in the creping adhesive in an amount of from about 0% to about 30%. In another embodiment, the inorganic cross-linking agent can be present in the creping adhesive in an amount of from about 1% to about 20%. In yet another embodiment, the inorganic cross-linking salt can be present in the creping adhesive in an amount of from about 1% to about 10% by weight based on the total solids of the creping adhesive composition. Zirconium compounds for use according to the present invention include those obtainable from EKA Chemicals Co. (previously Hopton Industries) and Magnesium Elektron, Inc. Appropriate commercial zirconium compounds from EKA Chemicals Co. are AZCOTE 5800M and KZCOTE 5000 and from Magnesium Elektron, Inc. are AZC or KZC.

Optionally, the creping adhesive according to the present invention can include any other art recognized components, including, but not limited to, organic cross-linkers, hydrocarbon oils, surfactants, amphoterics, humectants, plasticizers, or other surface treatment agents. An extensive, but non-exhaustive, list of organic cross-linkers includes glyoxal, maleic anhydride, bismaleimide, bis acrylamide, and epihalohydrin. The organic cross-linkers can be cyclic or non-cyclic compounds. Plastizers for use in the present invention can include propylene glycol, diethylene glycol, triethylene glycol, dipropylene glycol, and glycerol.

The creping adhesive may be applied as a single composition or may be applied in its component parts. More particularly, the polyamide resin may be applied separately from the polyvinyl alcohol (PVOH) and the modifier.

According to the present invention, an absorbent paper web is made by dispersing papermaking fibers into aqueous furnish (slurry) and depositing the aqueous furnish onto the forming wire of a papermaking machine. Any suitable forming scheme might be used. For example, an extensive but non-exhaustive list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon fabric-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent fibers, preferably in the range of from about 2.5 to about 4.5 weight percent. The pulp slurry is added to a foamed liquid comprising water, air and surfactant containing 50 to 80 percent air by volume forming a foamed fiber furnish having a consistency in the range of from about 0.1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof; said chemicals optionally comprising polyols, starches, PPG esters, PEG esters, phospholipids, surfactants, polyamines, HMCP (Hydrophobically Modified Cationic Polymers), HMAP (Hydrophobically Modified Anionic Polymers) or the like.

The pulp can be mixed with strength adjusting agents such as wet strength agents, dry strength agents and debonders/softeners and so forth. Suitable wet strength agents are known to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the trade name of PAREZ 631NC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. Nos. 3,700,623 and 3,772,076 each of which is incorporated herein by reference in its entirety. An extensive description of polymeric-epihalohydrin resins is given in Chapter 2*: Alkaline-Curing Polymeric Amine-Epichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable temporary wet strength agents may likewise be included. A comprehensive but non-exhaustive list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as, PAREZ 745, manufactured by Bayer can be used, along with those disclosed, for example in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such glyoxylated polyacrylamide resins are produced by reacting acrylamide with diallyl dimethyl ammonium chloride (DADMAC) to produce a cationic polyacrylamide copolymer which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Bayer Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxymethyl cellulose and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including but not limited to the class of amido amine salts derived from partially acid neutralized amines. Such materials are disclosed in U.S. Pat. No. 4,720,383. Evans, *Chemistry and Industry*, 5 Jul. 1969, pp. 893-903; Egan, *J.Am. Oil Chemist's Soc.*, Vol. 55 (1978), pp. 118-121; and Trivedi et al., *J.Am.Oil Chemist's Soc.*, June 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component as well as a nonionic surfactant.

In some embodiments, a particularly preferred debonder composition includes a quaternary amine component as well as a nonionic surfactant.

Suitable open texture fabrics for use in connection with the invention include single layer, multi-layer, or composite preferably open meshed structures, such as dryer fabrics or impression fabrics as are well known in the art. Fabrics may have at least one of the following characteristics: (1) on the side of the creping fabric that is in contact with the wet web (the "top" side), the number of machine-direction (MD) strands per inch (mesh) is from 10 to 200 and the number of cross-direction (CD) strands per inch (count) is also from 10 to 200; (2) The strand diameter is typically smaller than 0.050 inch; (3) on the top side, the distance between the highest point of the MD knuckles and the highest point on the CD knuckles is from about 0.001 to about 0.02 or 0.03 inch; (4) In between these two levels there can be knuckles formed either by MD or CD strands that give the topography a three dimensional hill/valley appearance which is imparted to the sheet during a Rush Transfer or a Fabric Creping step; (5) The fabric may be oriented in any suitable way so as to achieve the desired effect on processing and on properties in the product; the long warp knuckles may be on the top side to increase MD ridges in the product, or the long shute knuckles may be on the top side if more CD ridges are desired to influence creping characteristics as the web is transferred from the transfer cylinder to the creping fabric; and (6) the fabric may be made to show certain geometric patterns that are pleasing to the eye, which is typically repeated between every two to 50 warp yarns. Suitable commercially available coarse fabrics include a number of fabrics made by Voith Fabrics.

The open texture fabric may thus be of the class described in U.S. Pat. No. 5,607,551 to Farrington et al, Cols. 7-8 thereof, as well as the fabrics described in U.S. Pat. No. 4,239,065 to Trokhan and U.S. Pat. No. 3,974,025 to Ayers. Such fabrics may have about 20 to about 60 meshes per inch and are formed from monofilament polymeric fibers having diameters typically ranging from about 0.008 to about 0.025 inches. Both warp and weft monofilaments may, but need not necessarily be of the same diameter.

In some cases the filaments are so woven and complimentarily serpentinely configured in at least the Z-direction (the thickness of the fabric) to provide a first grouping or array of coplanar top-surface-plane crossovers of both sets of filaments; and a predetermined second grouping or array of sub-top-surface crossovers. The arrays are interspersed so that portions of the top-surface-plane crossovers define an array of wicker-basket-like cavities in the top surface of the fabric which cavities are disposed in staggered relation in both the machine direction (MD) and the cross-machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material; the top surfaces of the coplanar top-surface-plane crossovers may be monoplanar flat surfaces. Specific embodiments of the invention include satin weaves as well as hybrid weaves of three or greater sheds, and mesh counts of from about 10×10 to about 120×120 filaments per inch (4×4 to about 47×47 per centimeter). Although the preferred range of mesh counts is from about 18 by 16 to about 55 by 48 filaments per inch (9×8 to about 22×19 per centimeter).

Instead of an impression fabric as described immediately above, a dryer fabric may be used as the open texture fabric if so desired. Suitable fabrics are described in U.S. Pat. No. 5,449,026 (woven style) and U.S. Pat. No. 5,690,149 (stacked MD tape yarn style) to Lee as well as U.S. Pat. No. 4,490,925 to Smith (spiral style).

A rush transfer is carried out at a web consistency of from about 10 to 30 percent, preferably less than 30 percent and occurs as a fixed gap transfer as opposed to fabric creping under pressure. Typically a rush transfer is carried out at a Rush Transfer Ratio of from about 10 to about 30 percent at a consistency of from about 10 to about 30 percent, while a high solids fabric crepe in a pressure nip is usually at a consistency of at least 35 percent. Further details as to rush transfer appear in U.S. Pat. No. 4,440,597 to Wells et al. Typically, rush transfer is carried out using vacuum to assist in detaching the web from the donor fabric and thereafter attaching it to the receiving or receptor fabric. In contrast, vacuum is not required in a fabric creping step, so accordingly when we refer to fabric creping as being "under pressure" we are referring to loading of the receptor fabric against the transfer surface although vacuum assist can be employed at the expense of further complication of the system so long as the amount of vacuum is not sufficient to interfere with rearrangement or redistribution of the fiber.

If a Fourdrinier former is used nascent, the web is conditioned with vacuum boxes and a steam shroud until it reaches a solids content suitable for transferring to another fabric.

The desired redistribution of fiber is achieved by an appropriate selection of consistency, fabric or fabric pattern, nip parameters, and velocity delta, the difference in speed between the transfer surface and creping fabric. Velocity deltas of at least 100 fpm, 200 fpm, 500 fpm, 1000 fpm, 1500 fpm or even in excess of 2000 fpm may be needed under some conditions to achieve the desired redistribution of fiber and combination of properties as will become apparent from the discussion which follows. In many cases, velocity deltas of from about 500 fpm to about 2000 fpm will suffice. Forming of the nascent web, for example, control of a headbox jet and forming wire or fabric speed is likewise important in order to achieve the desired properties of the product, especially MD/CD tensile ratio.

The following salient parameters are selected or controlled in order to achieve a desired set of characteristics in the product: consistency at a particular point in the process (especially at fabric crepe); fabric pattern; fabric creping nip parameters; fabric crepe ratio; velocity deltas, especially transfer surface/creping fabric and headbox jet/forming wire; and post fabric-crepe handling of the web. The products of the invention are compared with conventional products in Table 3 below.

TABLE 3

Comparison of Typical Web Properties

| Property | Conventional Wet Press | Conventional Throughdried | High Speed Fabric Crepe |
|---|---|---|---|
| SAT g/g | 4 | 10 | 6-9 |
| *Caliper | 40 | 120+ | 50-115 |
| MD/CD Tensile | >1 | >1 | <1 |
| CD Stretch (%) | 3-4 | 7-15 | 5-15 |

*mils/8sheet

The present invention offers the advantage that relatively low grade, or otherwise available energy sources may be used to provide the thermal energy used to dry the web. That is to say, it is not necessary in accordance with the invention to provide through drying quality heated air or heated air suitable for a drying hood inasmuch as dryer cans may be heated from any source including waste recovery or thermal recovery from a co-generation source, for example. Another advantage of the invention is that it may utilize large portions of existing manufacturing assets such as can dryers and Fourdrinier formers of flat paper machines in order to make premium basesheet for tissue and towel, requiring only modest modifications to the existing assets, thus lowering dramatically the required capital investment to make premium products.

One preferred way of practicing the invention includes can-drying the web while it is in contact with the creping fabric which also serves as the drying fabric. Can drying can be used alone or in combination with impingement air drying, the combination being especially convenient if a two tier drying section layout is available as hereinafter described. Impingement air drying may also be used as the only means of drying the web as it is held in the creping fabric if so desired. Suitable rotary impingement air drying equipment is described in U.S. Pat. No. 6,432,267 to Watson and U.S. Pat. No. 6,447,640 to Watson et al. Inasmuch as the process of the invention can readily be practiced on existing equipment, any existing flat dryers can be advantageously employed so as to conserve capital as well.

Throughout the specification and Claims, when we refer to drying the web while it is held "in the creping fabric" or use like terminology, we mean that a substantial portion of the web protrudes into the interstices of the creping fabric, while of course another substantial portion of the web lies in close contact therewith.

Figure 2:
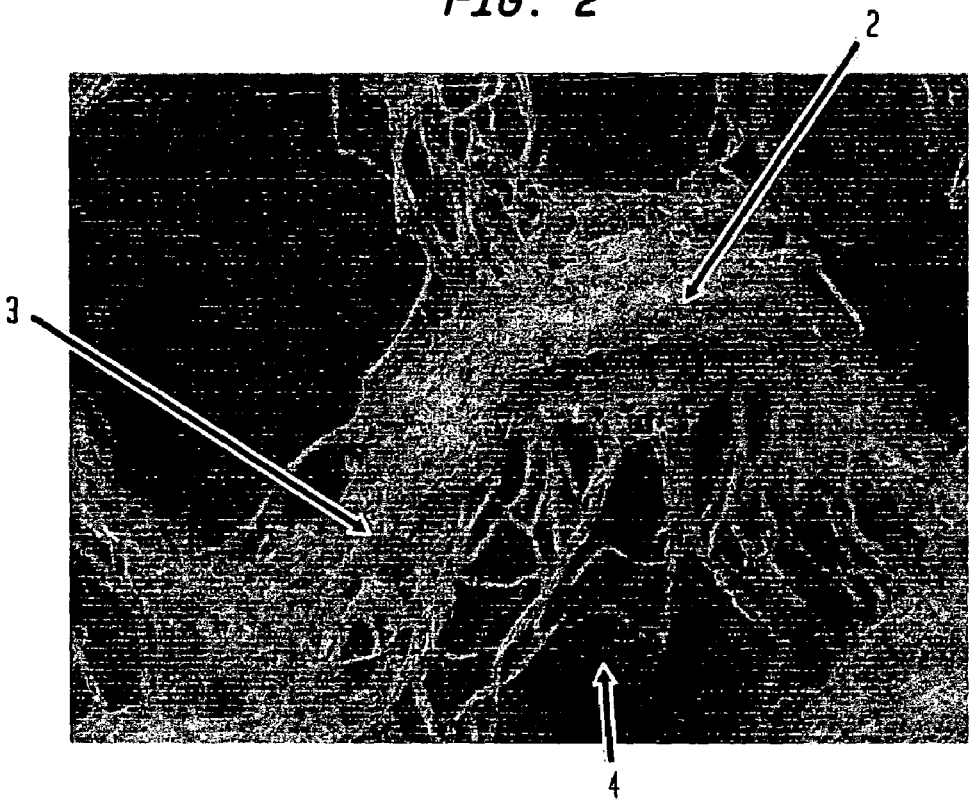
FIG. 2 is a photomicrograph showing enlarged detail (32×) of the web of FIG. 1.

Some preferred fabric creped products are appreciated by reference to FIGS. 1 through 18. These products were prepared by fabric creping from the surface of a cylinder in a pressure nip. FIG. 1 is a photomicrograph of a very low basis weight, open mesh web 1 having a plurality of relatively high basis weight pileated regions 2 interconnected by a plurality of lower basis weight linking regions 3. The cellulosic fibers of linking regions 3 have orientation which is biased along the direction as to which they extend between pileated regions 2, as is perhaps best seen in the enlarged view of FIG. 2. The orientation and variation in local basis weight is surprising in view of the fact that the nascent web has an apparent random fiber orientation when formed and is transferred largely undisturbed to a transfer surface prior to being wet-creped therefrom. The imparted ordered structure is distinctly seen at extremely low basis weights where web 1 has open portions 4 and is thus an open mesh structure.

Figure 3:
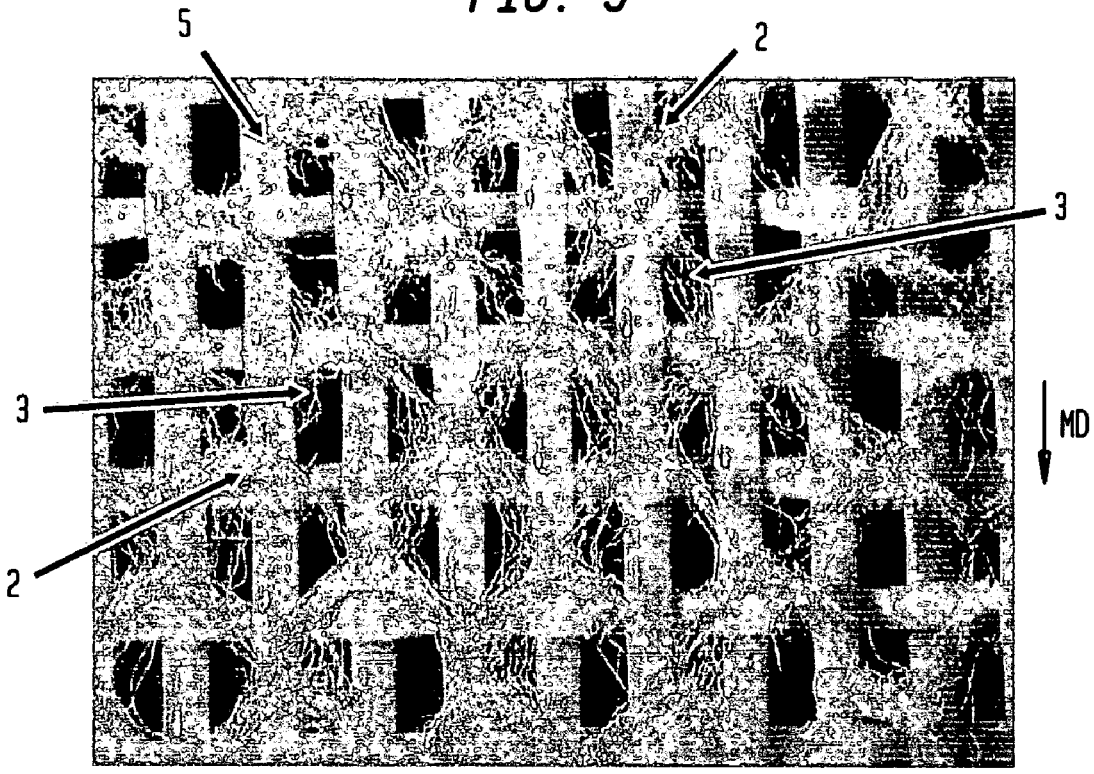
FIG. 3 is a photomicrograph (8×) showing the open mesh web of FIG. 1 placed on the creping fabric used to manufacture the web.

FIG. 3 shows a web together with the creping fabric 5 upon which the fibers were redistributed in a wet-creping nip after generally random formation to a consistency of 40-50 percent or so prior to creping from the transfer cylinder.

Figure 4:
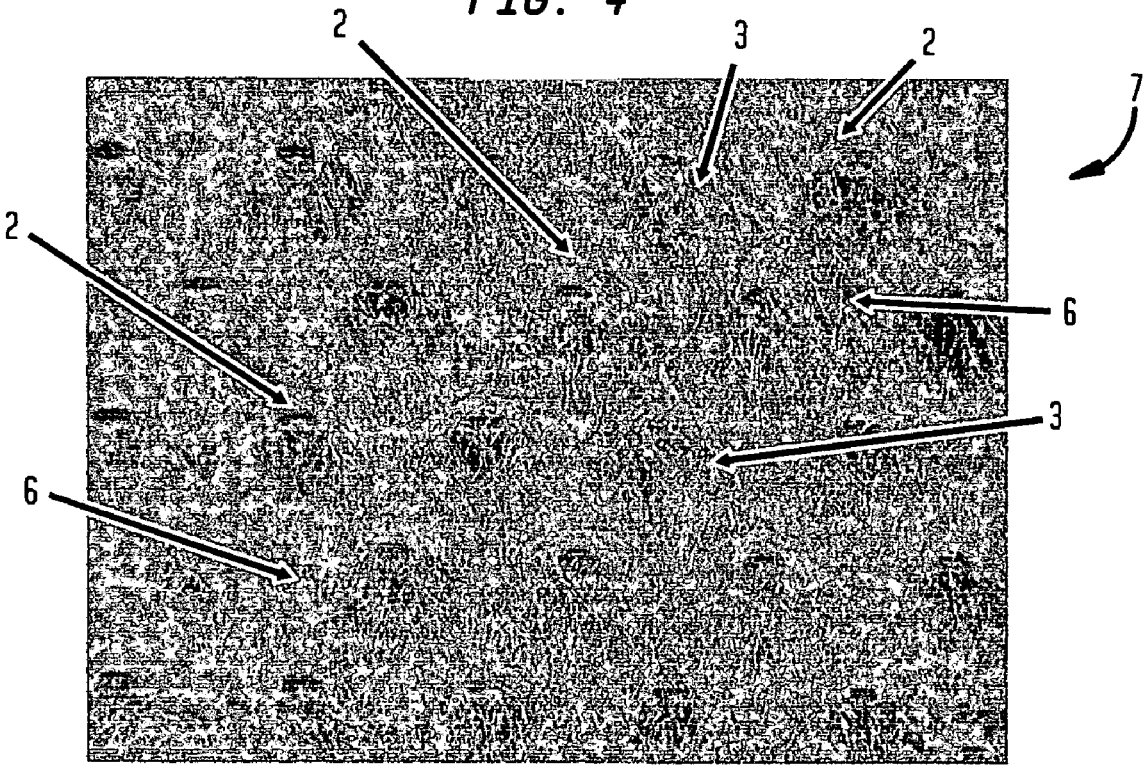
FIG. 4 is a photomicrograph showing a web having a basis weight of 19 lbs/ream produced with a 17% Fabric Crepe.
Figure 5:
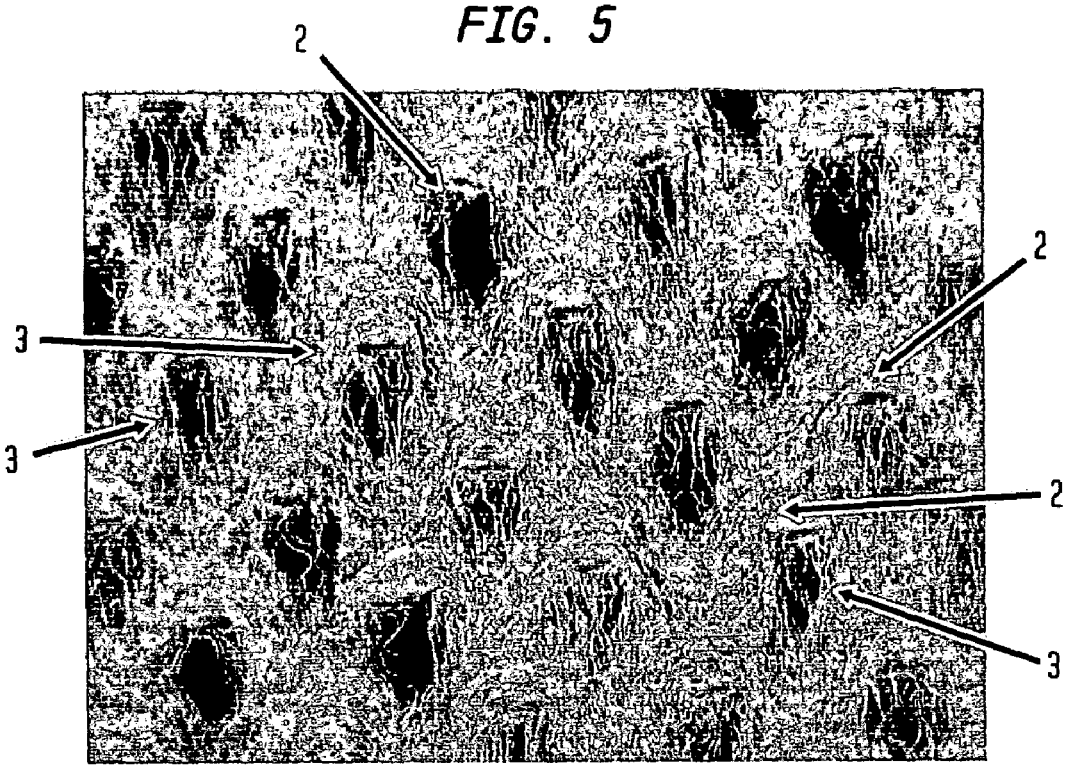
FIG. 5 is a photomicrograph showing a web having a basis weight of 19 lbs/ream produced with a 40% Fabric Crepe.
Figure 6:
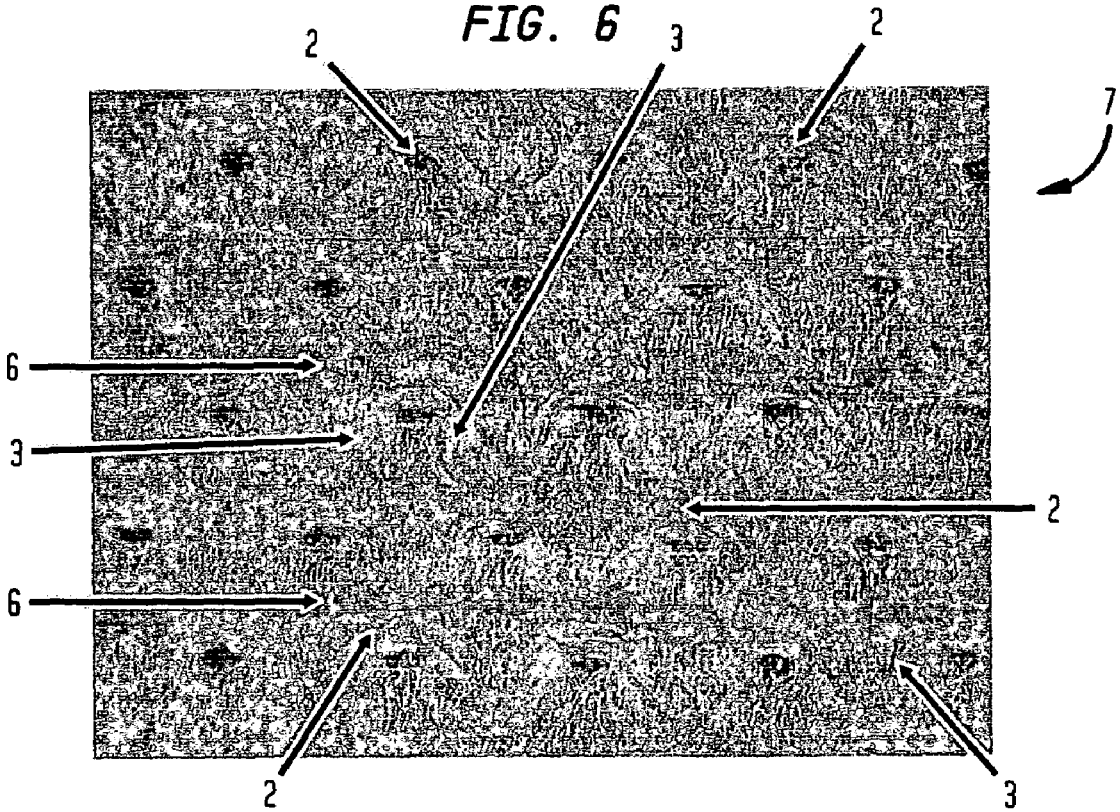
FIG. 6 is a photomicrograph showing a web having a basis weight of 27 lbs/ream produced with a 28% Fabric Crepe.

While the structure including the pileated and reoriented regions is easily observed in open meshed embodiments of very low basis weight, the ordered structure of the products of the invention is likewise seen when basis weight is increased where integument regions of fiber 6 span the pileated and linking regions as is seen in FIGS. 4 through 6 so that a sheet 7 is provided with substantially continuous surfaces as is seen particularly in FIGS. 4 and 6, where the darker regions are lower in basis weight while the almost solid white regions are relatively compressed fiber.

The impact of processing variables and so forth are also appreciated from FIGS. 4 through 6. FIGS. 4 and 5 both show 19 lb sheet; however, the pattern in terms of variation in basis weight is more prominent in FIG. 5 because the Fabric Crepe was much higher (40% vs. 17%). Likewise, FIG. 6 shows a higher basis weight web (27 lb) at 28% crepe where the pileated, linking and integument regions are all prominent.

Redistribution of fibers from a generally random arrangement into a patterned distribution including orientation bias as well as fiber enriched regions corresponding to the creping fabric structure is still further appreciated by reference to FIGS. 7 through 18.

Figure 7:
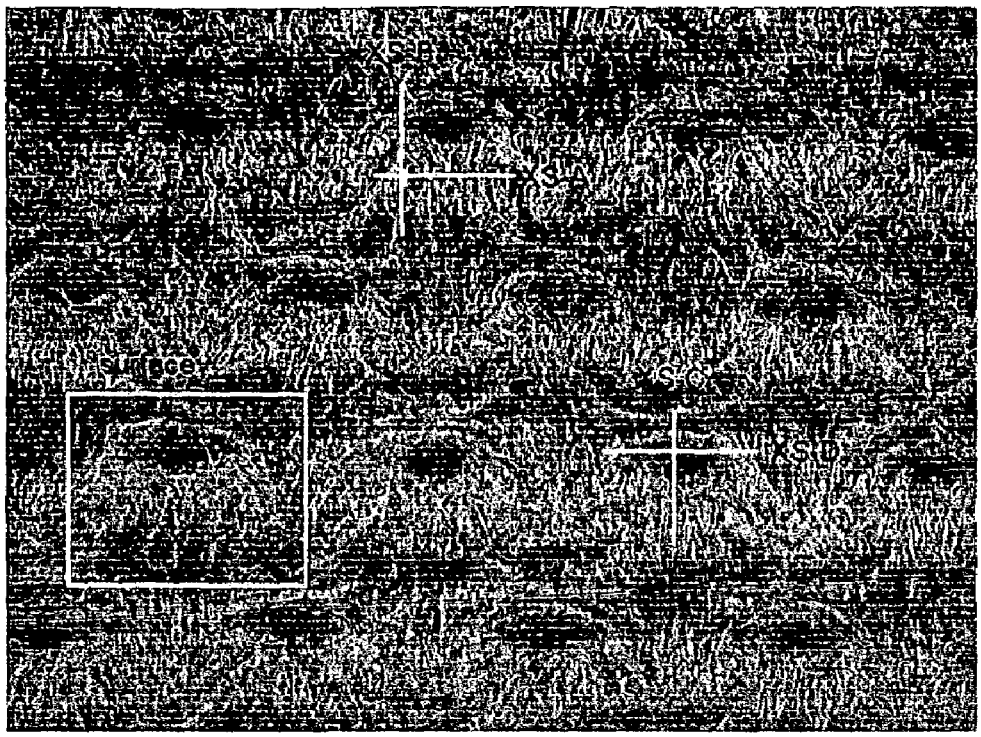
FIG. 7 is a surface image (10×) of an absorbent sheet, indicating areas where samples for surface and section SEMs were taken.
Figure 8:
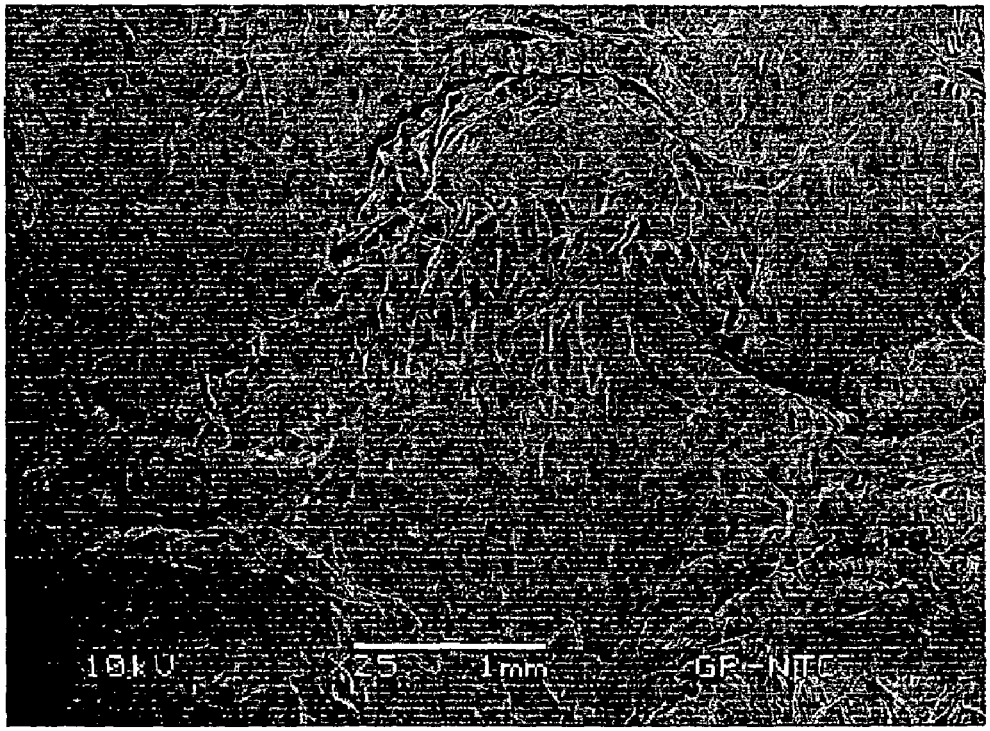
FIGS. 8-10 are surface SEMs of a sample of material taken from the sheet seen in FIG. 7.
Figure 9:
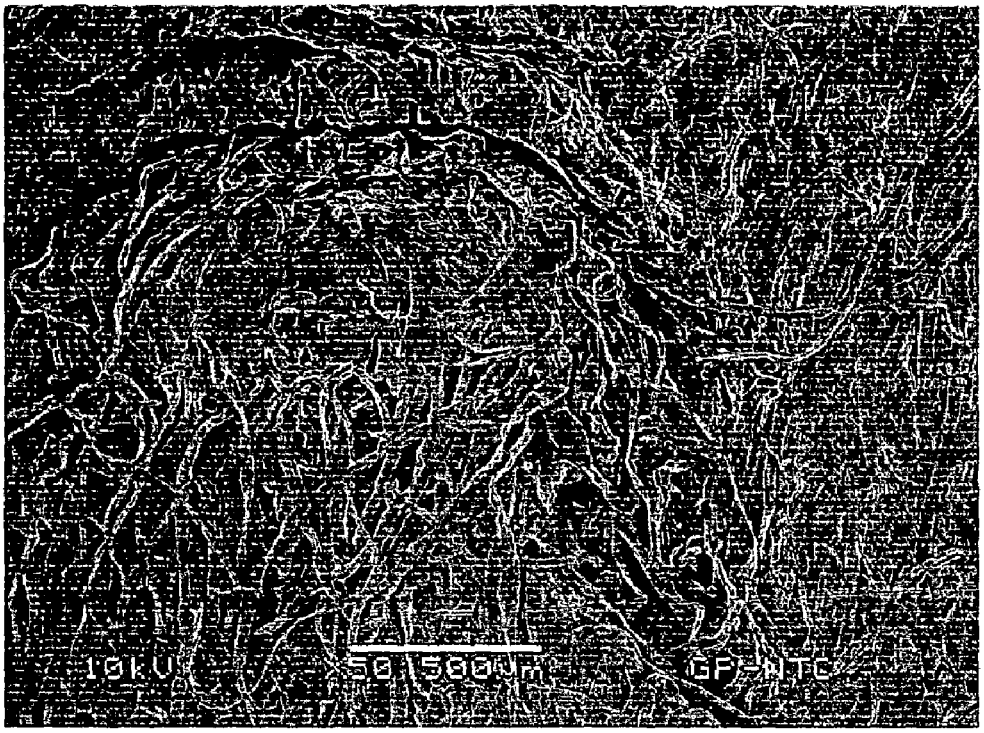
Figure 10:
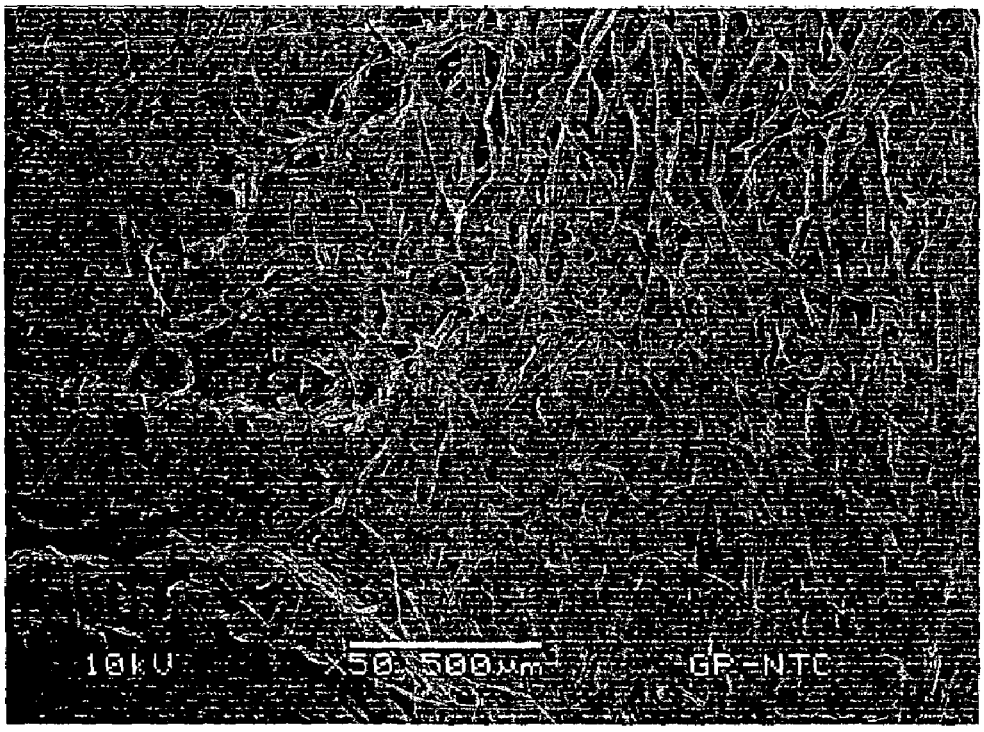

FIG. 7 is a photomicrograph (10×) showing a cellulosic web from which a series of samples were prepared and scanning electron micrographs (SEMs) made to further show the fiber structure. On the left of FIG. 7 there is shown a surface area from which the SEM surface images 8, 9 and 10 were prepared. It is seen in these SEMs that the fibers of the linking regions have orientation biased along their direction between pileated regions as was noted earlier in connection with the photomicrographs. It is further seen in FIGS. 8, 9 and 10 that the integument regions formed have a fiber orientation along the machine-direction. The feature is illustrated rather strikingly in FIGS. 11 and 12.

Figure 11:
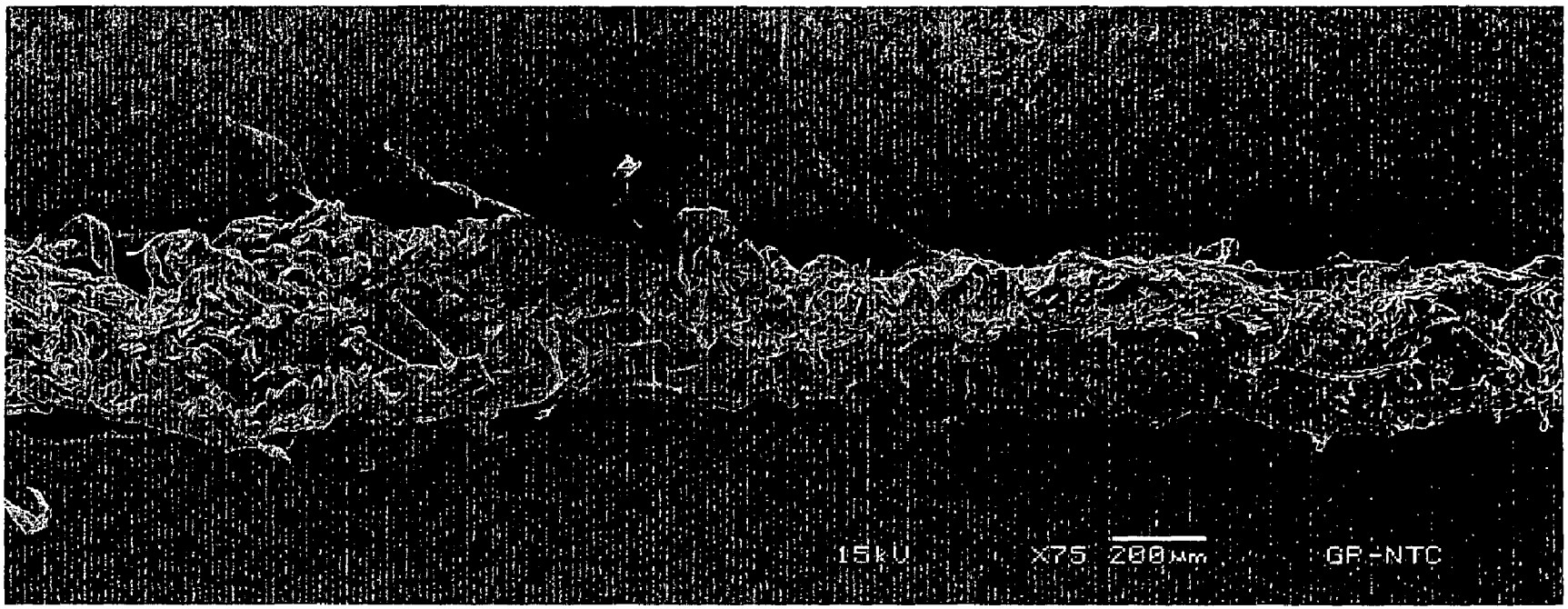
FIGS. 11 and 12 are SEMs of the sheet shown in FIG. 7 in section across the MD.
Figure 12:
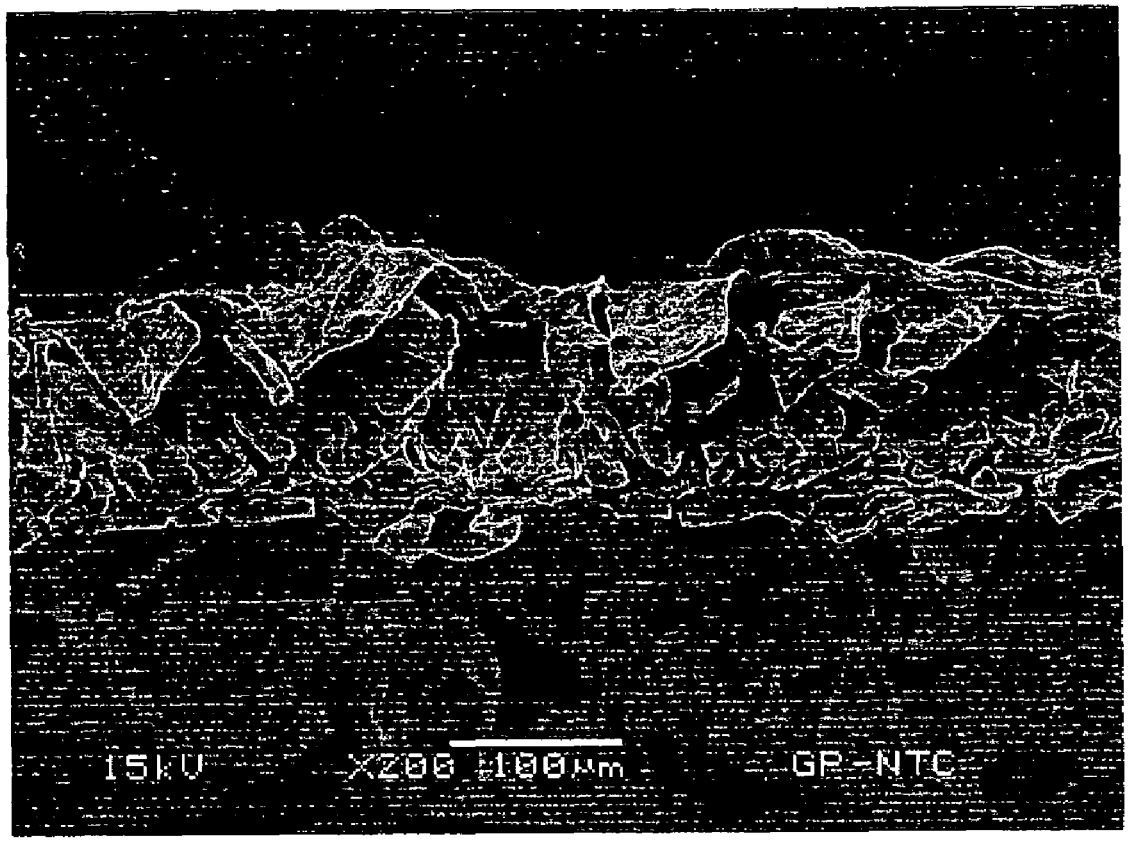

FIGS. 11 and 12 are views along line XS-A of FIG. 7, in section. It is seen especially at 200 magnification (FIG. 12) that the fibers are oriented toward the viewing plane, or machine-direction, inasmuch as the majority of the fibers were cut when the sample was sectioned.

Figure 13:
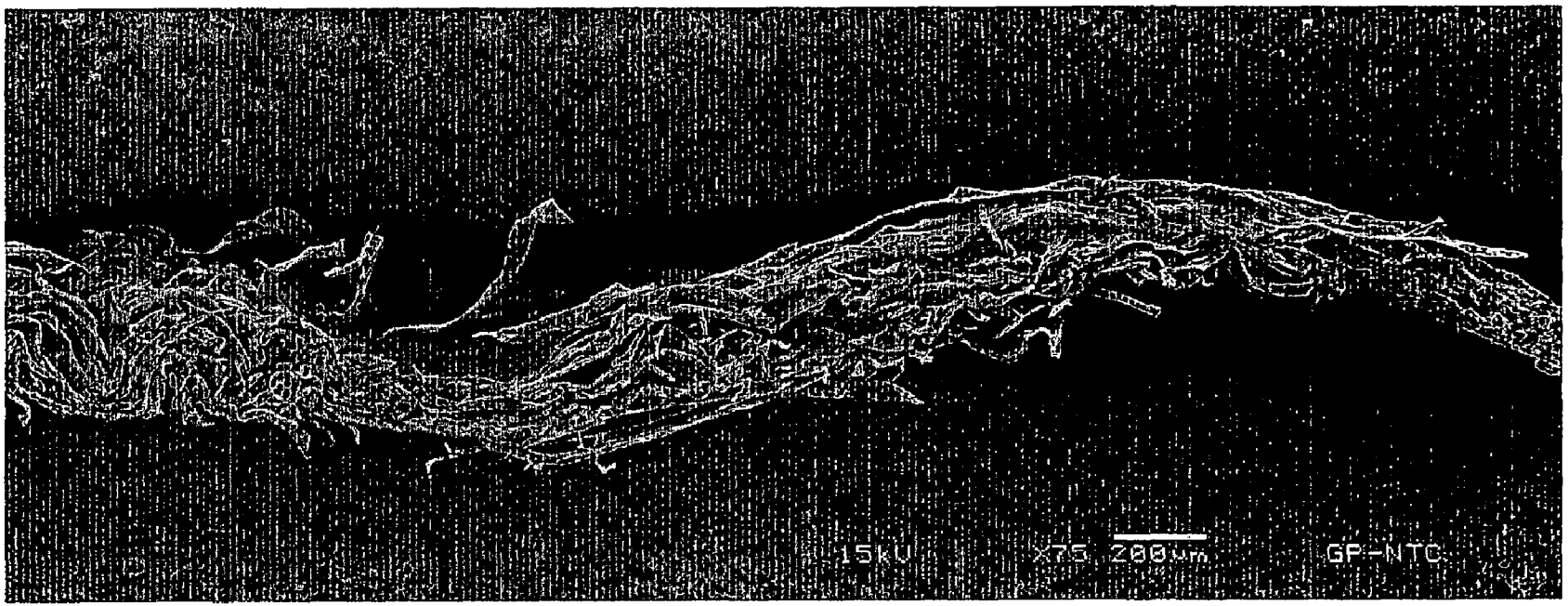
FIGS. 13 and 14 are SEMs of the sheet shown in FIG. 7 in section along the MD.
Figure 14:
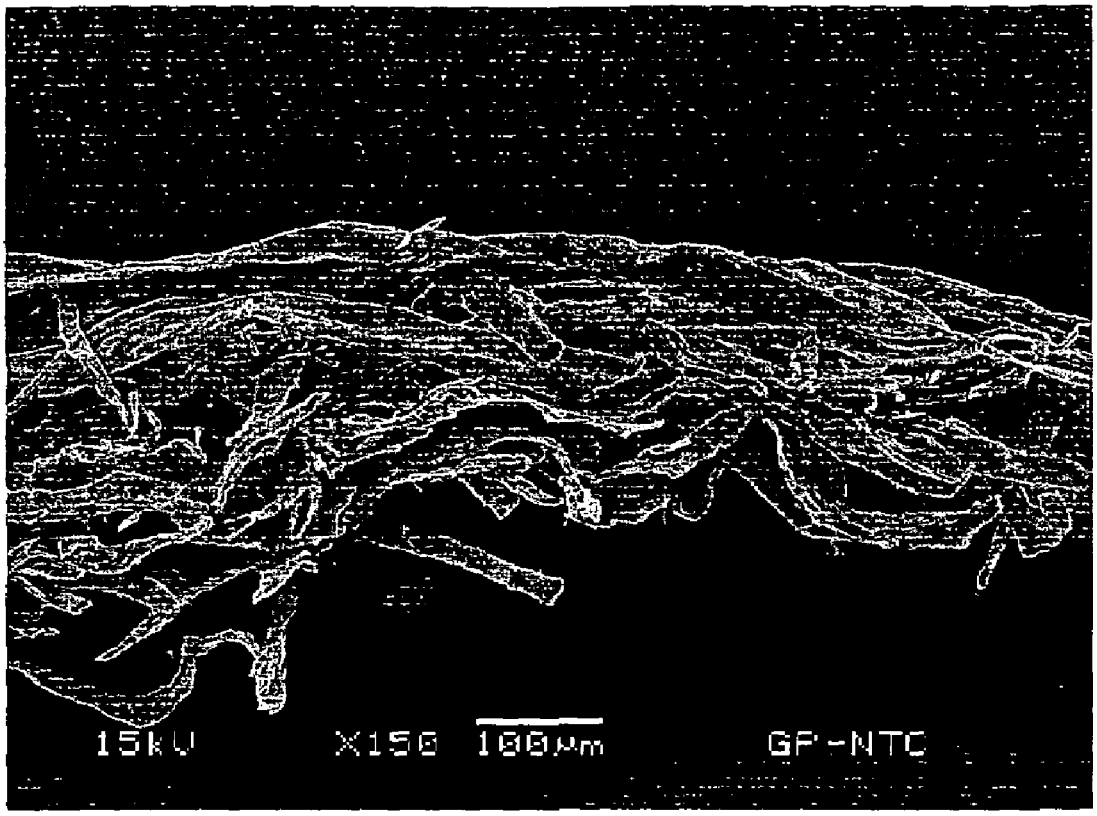

FIGS. 13 and 14, a section along line XS-B of the sample of FIG. 7, shows fewer cut fibers especially at the middle portions of the photomicrographs, again showing an MD orientation bias in these areas. Note in FIG. 13, U-shaped folds are seen in the fiber enriched area to the left. See also, FIG. 15.

Figure 15:
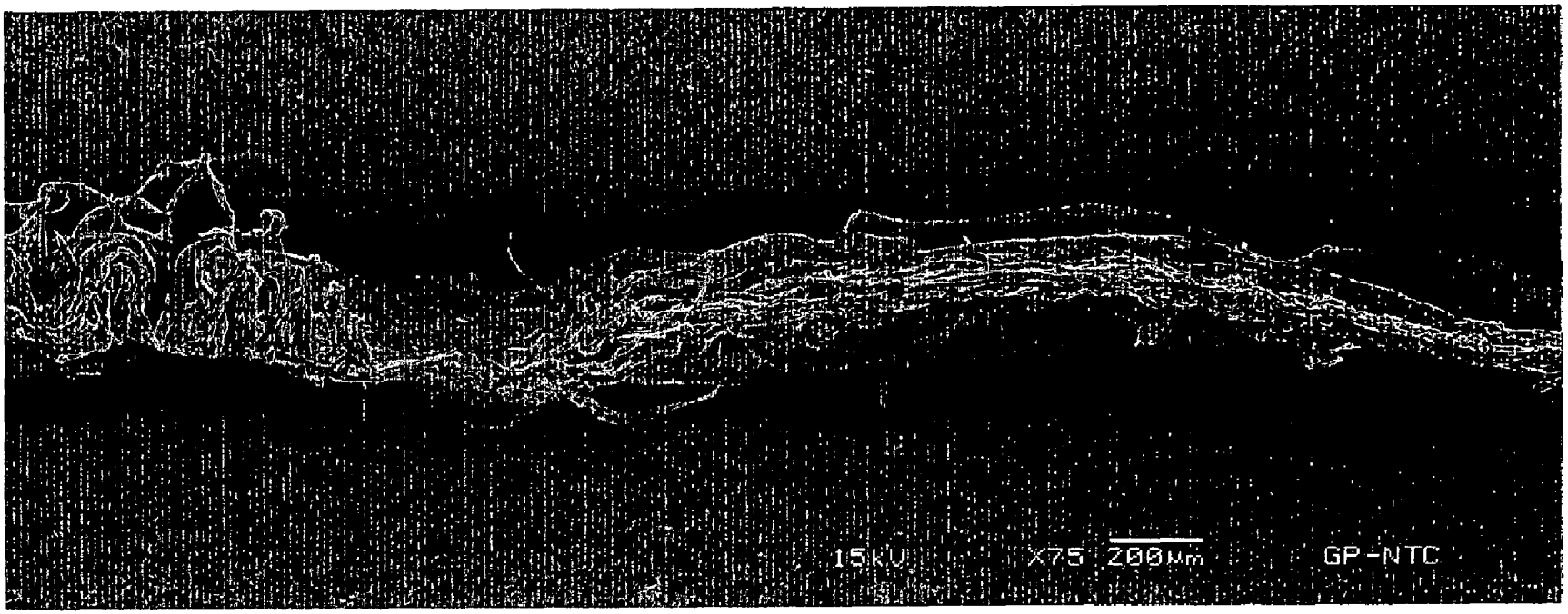
FIGS. 15 and 16 are SEMs of the sheet shown in FIG. 7 in section also along the MD.
Figure 16:
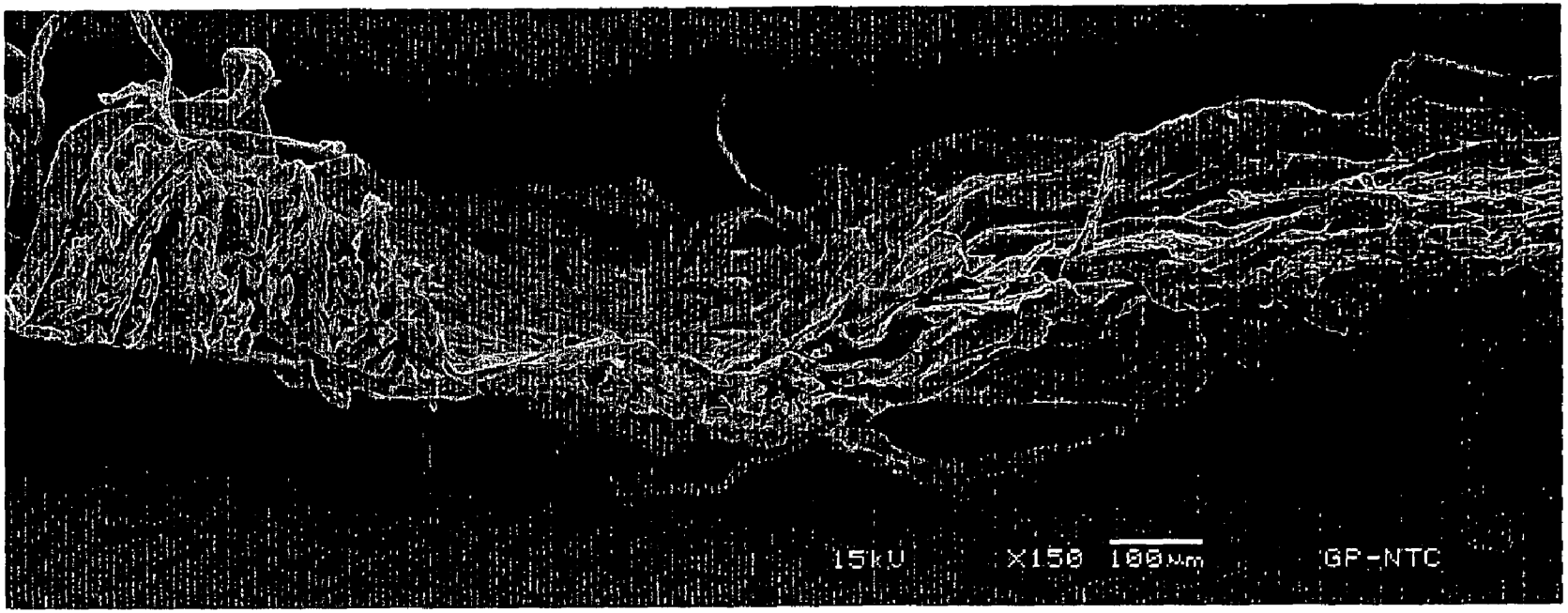

FIGS. 15 and 16 are SEMs of a section of the sample of FIG. 7 along line XS-C. It is seen in these Figures that the pileated regions (left side) are "stacked up" to a higher local basis weight. Moreover, it is seen in the SEM of FIG. 16 that a large number of fibers have been cut in the pileated region (left) showing reorientation of the fibers in this area in a direction transverse to the MD, in this case along the CD. Also noteworthy is that the number of fiber ends observed diminishes as one moves from left to right, indicating orientation toward the MD as one moves away from the pileated regions.

Figure 17:
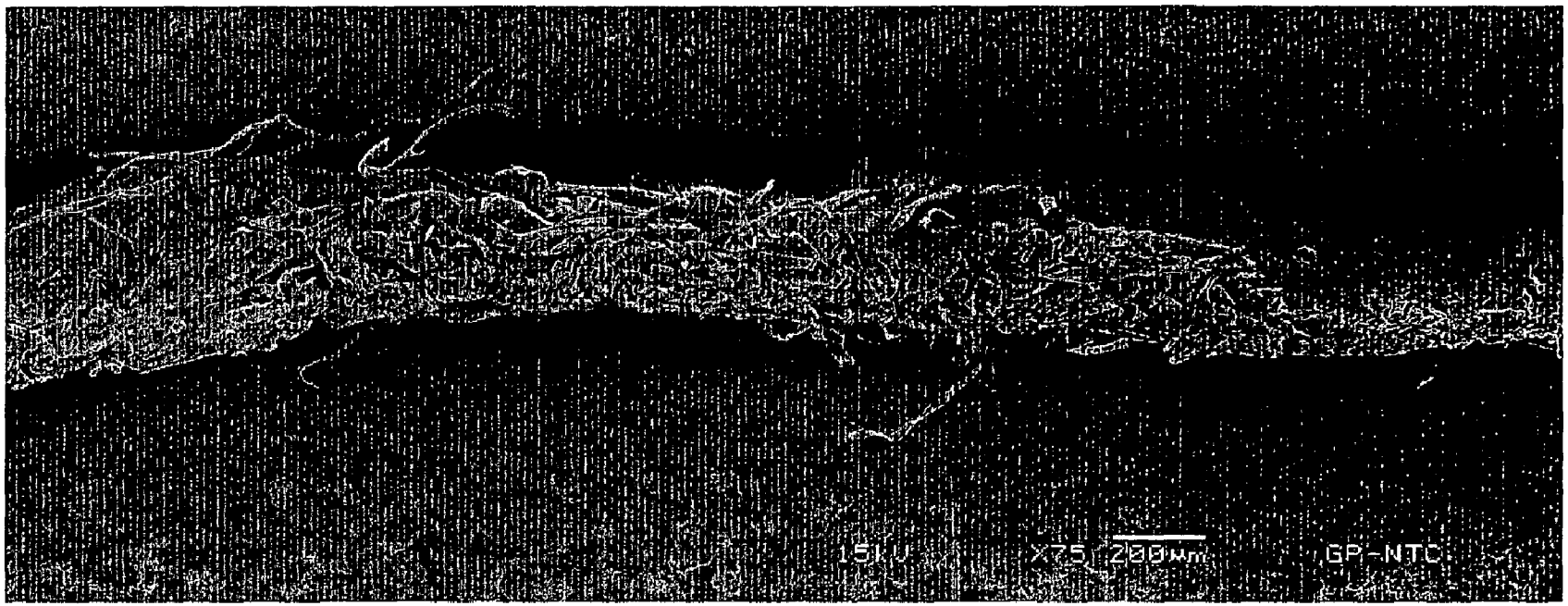
FIGS. 17 and 18 are SEMs of the sheet shown in FIG. 7 in section across the MD.
Figure 18:
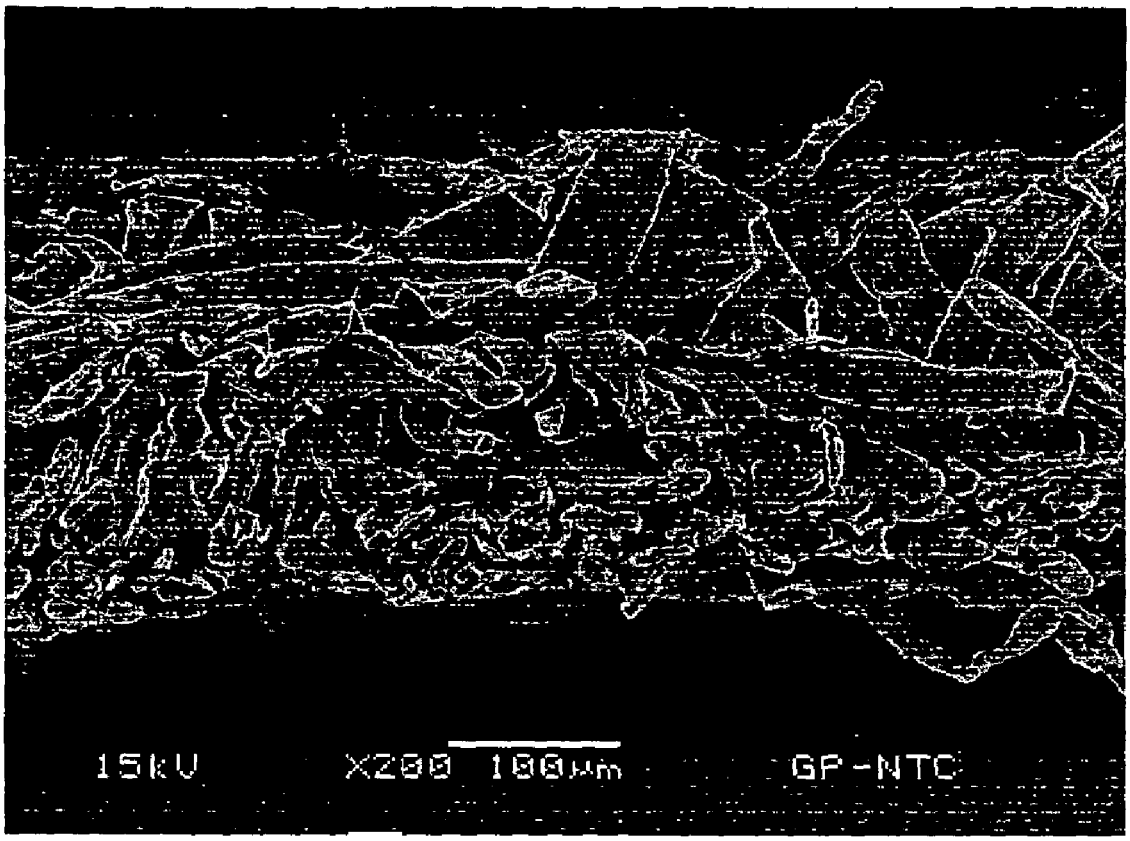

FIGS. 17 and 18 are SEMs of a section taken along line XS-D of FIG. 7. Here it is seen that fiber orientation bias changes as one moves across the CD. On the left, in a linking or colligating region, a large number of "ends" are seen indicating MD bias. In the middle, there are fewer ends as the edge of a pileated region is traversed, indicating more CD bias until another linking region is approached and cut fibers again become more plentiful, again indicating increased MD bias.

The method of the present invention is also applicable to products made without fabric creping. The structure of these products will resemble throughdried sheet.

Figure 19:
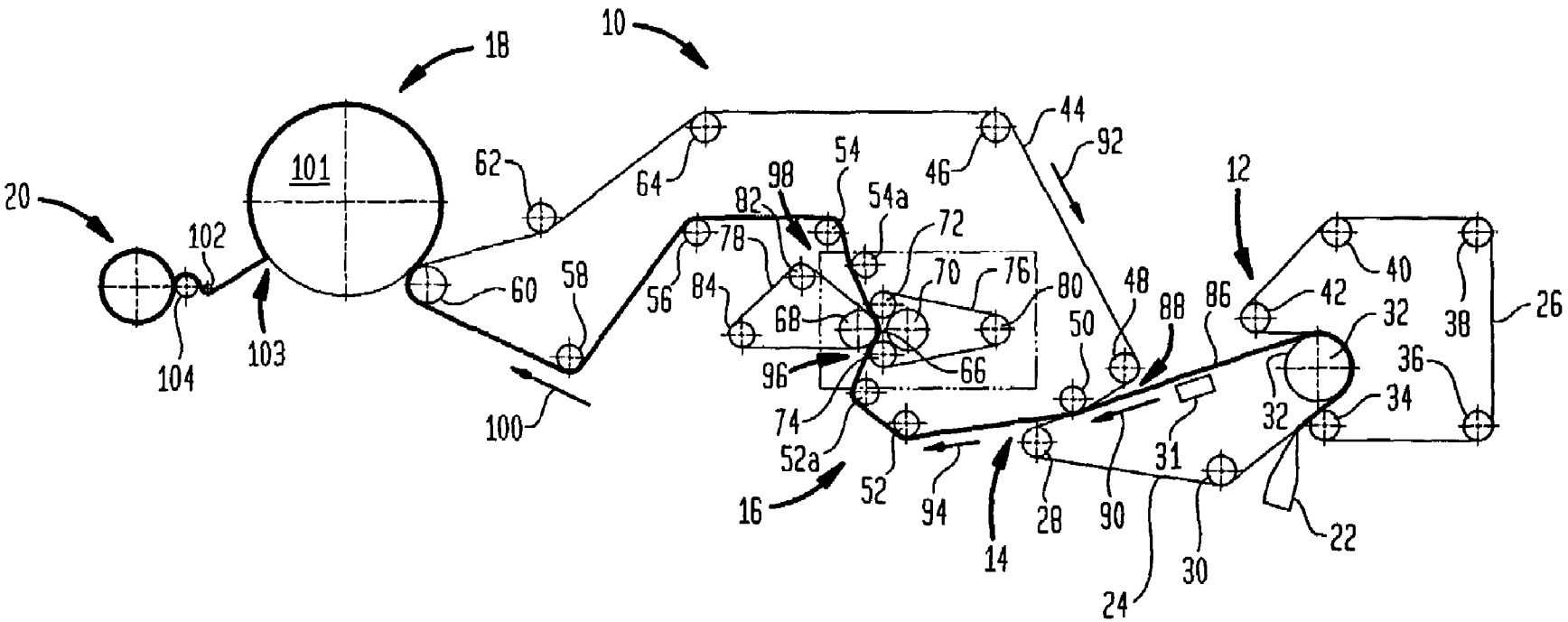
FIG. 19 is a schematic diagram of a first paper machine useful for practicing the process of the present invention.
Figure 19A:
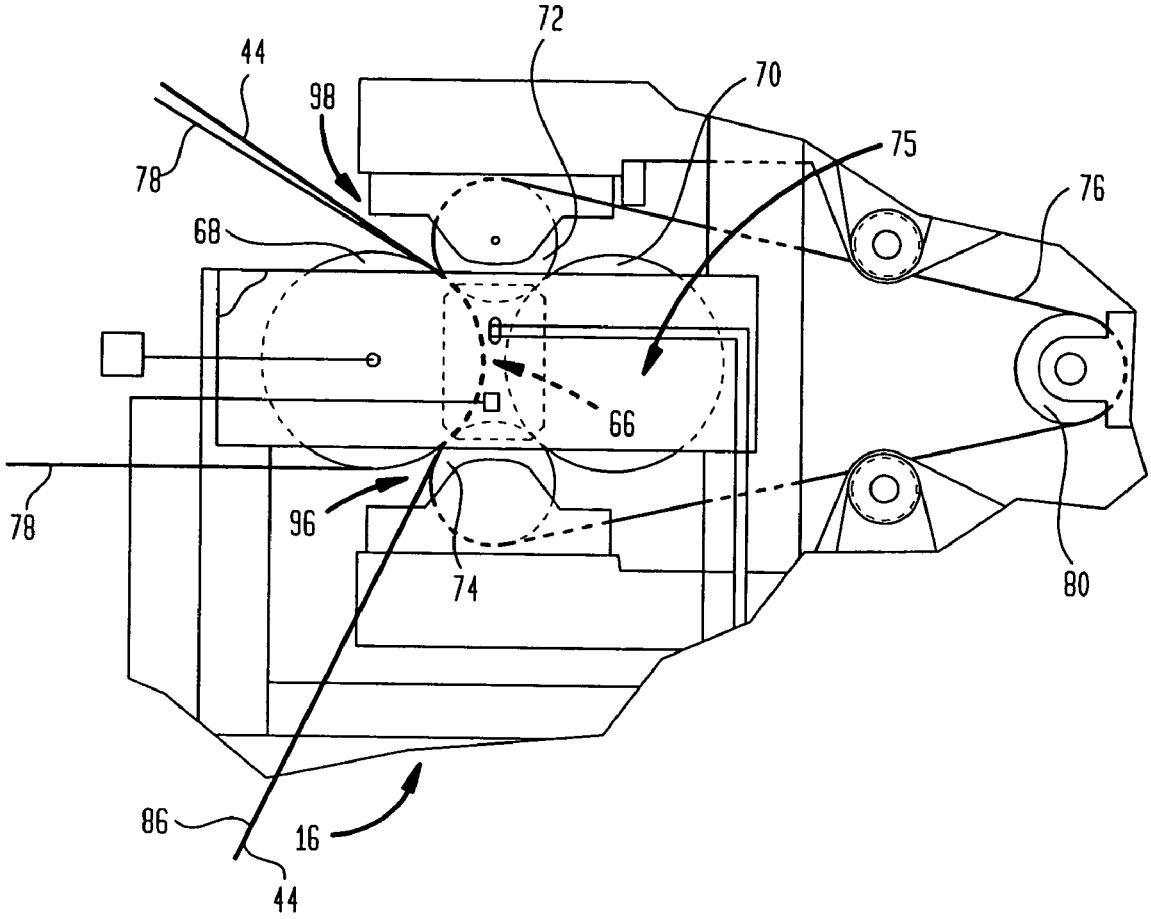
FIG. 19A is an enlarged detail of the schematic diagram of the first paper machine of FIG. 19 useful for practicing the process of the present invention.

Referring now to FIGS. 19 and 19A, there is illustrated a paper machine 10 including a forming section 12, a rush transfer area 14, a pneumatic dewatering station 16, a Yankee dryer 18, and a take-up reel 20.

Forming section 12 is referred to in the art as a twin wire former and includes a head box 22, a first wire 24, as well as a second wire 26. First wire 24 is supported on rolls 28 and 30 as well as by way of forming roll 32. Second wire 26 is mounted about rolls 34, 36, 38, 40, 42, as well as forming roll 32. Head box 22 deposits the furnish on wire 24 as will be described hereinafter.

Paper machine 10 also includes an open texture fabric 44 which extends from the forming section to Yankee dryer 18. As will be appreciated from the diagram, open texture fabric 44 is mounted on rollers 46, 48, 50, 52, 52*a*, 54, 54*a*, 56, 58, press roll 60, roll 62 and roll 64. The fabric is also supported in the pneumatic dewatering station as shown in FIGS. 19, 19A. Pneumatic watering station 16 includes a pressure chamber 66 defined, in part, by rolls 68, 70, 72, and 74, as well as side plates, such as 75. There is also included in the dewatering station a fluid distribution membrane 76 and an anti-rewet felt 78. Membrane 76 is supported on rolls 72, and 74 as well as another support roll 80. Felt 78 is supported on dewatering roll 68 as well as additional support rolls 82 and 84.

Fluid distribution membrane 76 is suitably a semi-permeable membrane as is disclosed in U.S. patent application No. US 2004/0089168 entitled "Semipermeable Membrane With Intercommunicating Pores for Pressing Apparatus". The membrane is about 0.1 inches thick, or less, and includes a formed fabric which is made semipermeable by forming a plurality of intercommunicating pores in the formed fabric having a size, shape, frequency and/or pattern selected to provide the desired permeability. The permeability is suitably selected to be greater than zero and less than about five CFM per square foot as measured by TAPPI test method TIP 0404-20, and more preferably, is selected to be greater than zero and less than about two CFM per square foot. Thus, semipermeable membrane 76 is both gas permeable and liquid permeable to a limited degree. The membrane is made semipermeable by starting with a carrier fabric which is very permeable, and then forming a plurality of intercommunicating pores in the carrier fabric. The carrier fabric has applied thereto a batting made of a blend of heat fusible and non-heat fusible fibers, which is needled into the carrier fabric. Heat is applied to the needled carrier fabric/batting to melt the heat fusible fibers, which in turn leaves voids in the form of intercommunicating pores, similar to those of a foam sponge.

Anti-rewet felt 78 is configured to provide one-way flow of water away from the web. Suitable felts are seen in U.S. Pat. No. 6,616,812 entitled "Anti-Rewet Felt for Use in a Papermaking Machine". The anti-rewet felt preferably is at least a two-layer fabric, having a perforated or porous polymer film layer. See the '812 patent at Columns 3-4 for further detail on suitable felts.

Paper machine 10 is operated by depositing a furnish onto forming wire 24 from head box 22. The furnish is applied to the wire at a low consistency, below 1 percent and the nascent web 86 is formed on the wire preferably by using a vacuum forming roll. That is to say, roll 32 is preferably a vacuum forming roll. On wire 24, the nascent web has a consistency typically in the range of from about 20 to 25 percent prior to rush transfer to open texture fabric 44. However, the web more generally has a consistency of from about 10 to about 30 percent during rush transfer to open texture fabric 44 at rush transfer nip 88 as shown in the diagram. In order to increase the consistency of the web, there is optionally provided a vacuum box 31. In this connection, fabric or wire 24 moves in the direction of arrow 90 at a first speed which is generally greater than the speed at which open texture fabric 44 moves in the direction indicated by arrow 92. The web thus undergoes micro-contraction in rush transfer nip 88. Generally the rush transfer ratio is anywhere from about 10 to about 30 percent, such as from 20-25 percent. That is to say, the web is micro-contracted as it is transferred from wire 24 to open texture fabric 44. The web is then conveyed to pneumatic dewatering station 16 by open texture fabric 44 in the direction indicated by arrow 94. The fabric and web pass through a first pressure nip 96 into chamber 66 which is maintained at an elevated pressure such that air or other gas is driven through membrane 76, web 86 and felt 78 so as to dewater the web. In this regard it should be appreciated that the pressure chamber is defined in part between rolls 68, 70, 72 and 74. It is seen in the diagram that open texture fabric 44 bearing the web 86 is combined with fluid distribution membrane 76 and an anti-rewet felt 78 as the three pass through nip 96 into a pressure chamber defined in part by a plurality of nip rolls, the fluid distribution membrane bearing against the side of the open texture fabric away from the web, with the anti-rewet felt bearing directly against the web. As web goes through nip 96 along with the fabrics and enter the pressure chamber, the web is dewatered by the elevated pressure in the chamber which forces the drying medium through membrane 76 then fabric 44 then the web and then felt 78 before exiting either through roll 68 or through grooves in the roll if so desired. The web and fabric 44 exit pressure chamber 66 through exit nip 98 as fabric 44 proceeds in the machine direction.

While dewatering station 16 is a compressive device by virtue of nips 96, 98 exerting force on the web while it is in contact with the fabrics, there is little, if any, irreversible densification that occurs. The web remains of relatively high bulk and is provided additional bulk if so desired by way of additional crepe.

It will be appreciated that pressure chamber 66 is defined at its end portion by end plates such as plate 75 or other suitable walls so that the interior pressure in chamber 66 may be maintained high enough to ensure flow through the web in order to dewater the web. The pressure in the chamber is preferably enough pressure so that there is at least about a 30 psi pressure drop across the web and fabrics. In the pressure chamber the web is dewatered to a consistency preferably of from about 45 to 50 percent before exiting through nip 98. The roller nip is a particularly convenient method by which to define the chamber. Without being bound by any theory, it is believed that the utilization of suitable semipermeable membranes, felts and pressures enables drying of the web to relatively high consistency by pneumatic pressure without causing channeling or other disruption of the web. Compression in the entrance and exit nips 96, 98 does not significantly reduce bulk and absorbency. Following pneumatic dewatering and exiting through nip 98, the web moves towards the Yankee dryer as shown by arrow 100 and is non-compactively pressed onto Yankee cylinder 101 so as to preserve the bulk imparted in rush transfer nip 88. Preferably, the web is adhered to the Yankee cylinder with a polyvinyl alcohol containing adhesive. On cylinder 101 the web is typically dried to a consistency of from about 94 to about 98 percent prior to being creped by way of creping blade 103 and conveyed over rolls 102, 104 to take-up reel 20. Blade 103 may be an undulatory creping blade as is seen in FIGS. 19B through 19E and disclosed in U.S. Pat. No. 5,690,788. Use of the undulatory creping blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products.

FIGS. 19B through 19E illustrate a portion of a preferred undulatory creping blade 103 useable in the practice of the present invention in which a relief surface 105 extends indefinitely in length, typically exceeding 100 inches in length and often reaching over 26 feet in length to correspond to the width of the Yankee dryer on the larger modern paper machines. Flexible blades of the patented undulatory blade having indefinite length can suitably be placed on a spool and used on machines employing a continuous creping system. In such cases the blade length would be several times the width of the Yankee dryer. The height of the blade 103 is usually on the order of several inches while the thickness of the body is usually on the order of fractions of an inch.

As illustrated in FIGS. 19B through 19E, an undulatory cutting edge 107 of the patented undulatory blade is defined by serrulations 109 disposed along, and formed in, one edge of the surface 105 so as to define an undulatory engagement surface. Cutting edge 107 is preferably configured and dimensioned so as to be in continuous undulatory engagement with Yankee 101 when positioned as shown in FIG. 19, that is, the blade continuously contacts the Yankee cylinder in a sinuous line generally parallel to the axis of the Yankee cylinder. In particularly preferred embodiments, there is a continuous undulatory engagement surface 111 having a plurality of substantially colinear rectilinear elongate regions 113 adjacent a plurality of crescent shaped regions 115 about a foot 117 located at the upper portion of the side 119 of the blade which is disposed adjacent the Yankee. Undulatory surface 111 is thus configured to be in continuous surface-to-surface contact over the width of a Yankee cylinder when in use in an undulatory or sinuous wave-like pattern. The number of teeth per inch may be taken as the number of elongate regions 113 per inch and the tooth depth is taken as the height, H, of the groove indicated at 121.

Figure 20:
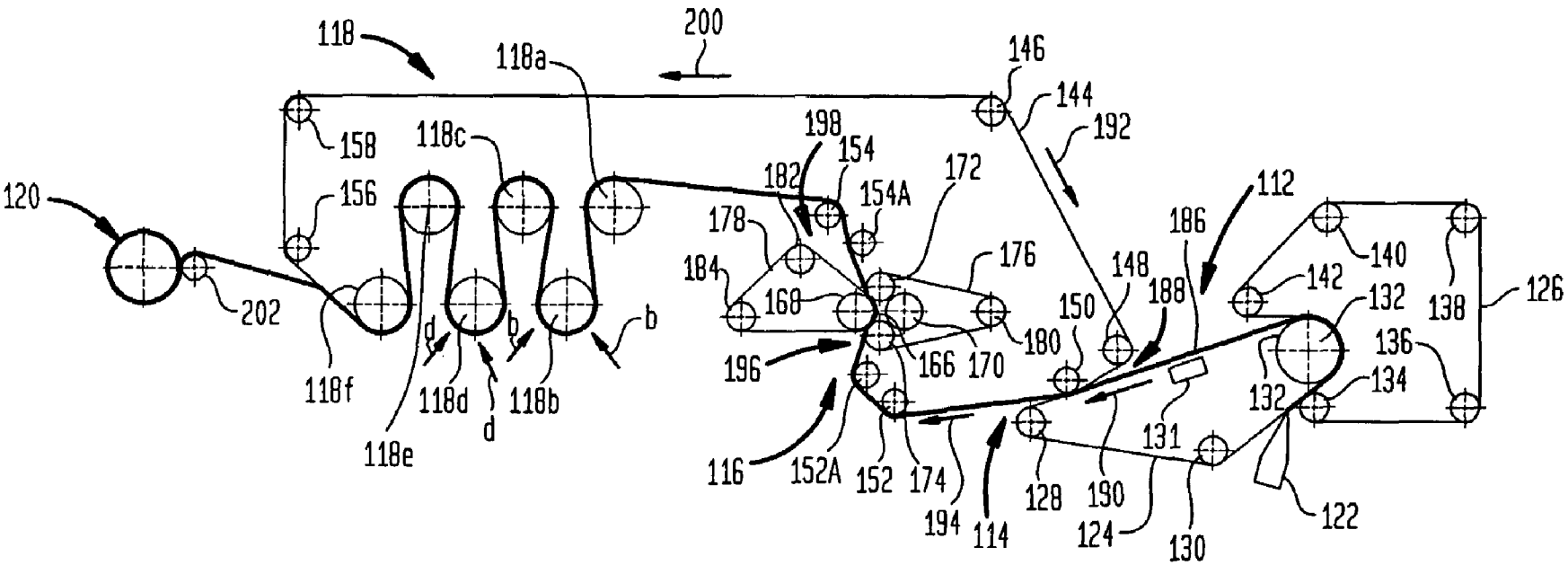
FIG. 20 is a schematic diagram of a second paper machine useful for practicing the process of the present invention.

Referring to FIG. 20, there is shown another paper machine 110 useful for practicing the present invention. Paper machine 110 includes a forming section 112, a rush transfer area 114, a pneumatic dewatering station 116, a drying section indicated at 118, as well as a take-up roll 120. Forming section 112 includes a twin wire former, as well as a head box 122, a first wire 124, and a second wire 126. Wire 124 is mounted about support rolls 128, 130 as well as a suction forming roll 132. Section 112 optionally includes a vacuum box 131. Wire 126 is mounted about a plurality of support rolls 134, 136, 138, 140, and 142 as well as forming roll 132. Fabric or wire 124 is in proximity to an open texture fabric 144 that carries a formed web forward for dewatering and drying as further described herein.

Open texture fabric 144 is mounted about a plurality of support rolls 146, 148, 150, 152, 152A, 154, 154A, 156, 158, as well as a plurality of can dryers as is shown in the diagram.

Dewatering station 116 includes a plurality of rolls which define a pressure chamber 166. More specifically, pressure chamber 166 is defined between rolls 168, 170, 172 and 174. There is further provided a fluid distribution membrane 176 and an anti-rewet felt 178. Membrane 176 is mounted about rolls 180, 172, and 174, while felt 178 is mounted about rolls 168, 182 and 184.

Drying section 118 includes a plurality of can dryers 118*a*, 118*b*, 118*c*, 118*d*, 118*e*, and 118*f*.

In order to form an absorbent sheet, a furnish is deposited at low consistency onto fabric 124 by head box 122. Typically the initial consistency is less than 1 percent. The nascent web 186 is partially dewatered by a suction forming roll 132 typically to a consistency of from about 20 to about 25 percent.

After its initial formation, nascent web 186 is conveyed in the direction indicated by arrow 190 to a rush transfer nip 188. Fabric 124 travels at a first speed which is greater than the speed at which the open texture fabric 144 travels in the direction indicated by arrow 192. Thus the web undergoes micro-contraction in nip 188 to increase bulk as it is transferred to open texture fabric 144. A Rush Transfer Ratio of about 10-30 percent is preferred, as is a consistency of from about 20-25 percent. After rush transfer, the web moves in the direction indicated by arrow 194 to pneumatic dewatering station 116.

At the pneumatic dewatering station the web passes first through a first sealing nip 196 to enter into chamber 166 which is typically maintained at elevated pressure, as noted above in connection with FIG. 19. As the web passes through the pneumatic dewatering station, the elevated pressure in chamber 166 forces air or other gas through membrane 176, fabric 144, web 186 and felt 178. Water is thus forced from the nascent web which is raised to a consistency typically of from about 45 to 50 percent. The web exits chamber 166 via pressure nip 198 and is conveyed to drying station 118 by fabric 144 in direction 200, referred to as the machine direction, to can dryers 118*a*, 118*b*, 118*c*, 118*d*, 118*e*, and 118*f* in drying section 118. Thereafter, the web is separated from fabric 144 and wound up on reel 120 optionally cooperating with another support roll 202. Typically the web is wound up at a consistency of anywhere from about 94 to about 98 percent. In some embodiments of the invention, it is desirable to eliminate open draws in the process, such as the open draw between the creping and drying fabric and reel 120. This is readily accomplished by extending the creping fabric to the reel drum and transferring the web directly from the fabric to the reel as is disclosed generally in U.S. Pat. No. 5,593,545 to Rugowski et al.

In dryer section 118, cans 118*b, d* and *f* are in a first tier and cans 118*a*, 118*c* and 118*e* are in a second tier. Cans 118*a*, 118*c* and 118*e* directly contact the web, whereas cans in the other tier contact the fabric. In this two tier arrangement where the web is separated from cans 118*b, d* and *f* by the fabric, it is sometimes advantageous to provide impingement air dryers at 118*b* and 118*d*, which may be drilled cans, such that air flow is indicated schematically at b and d, respectively.

Figure 21:
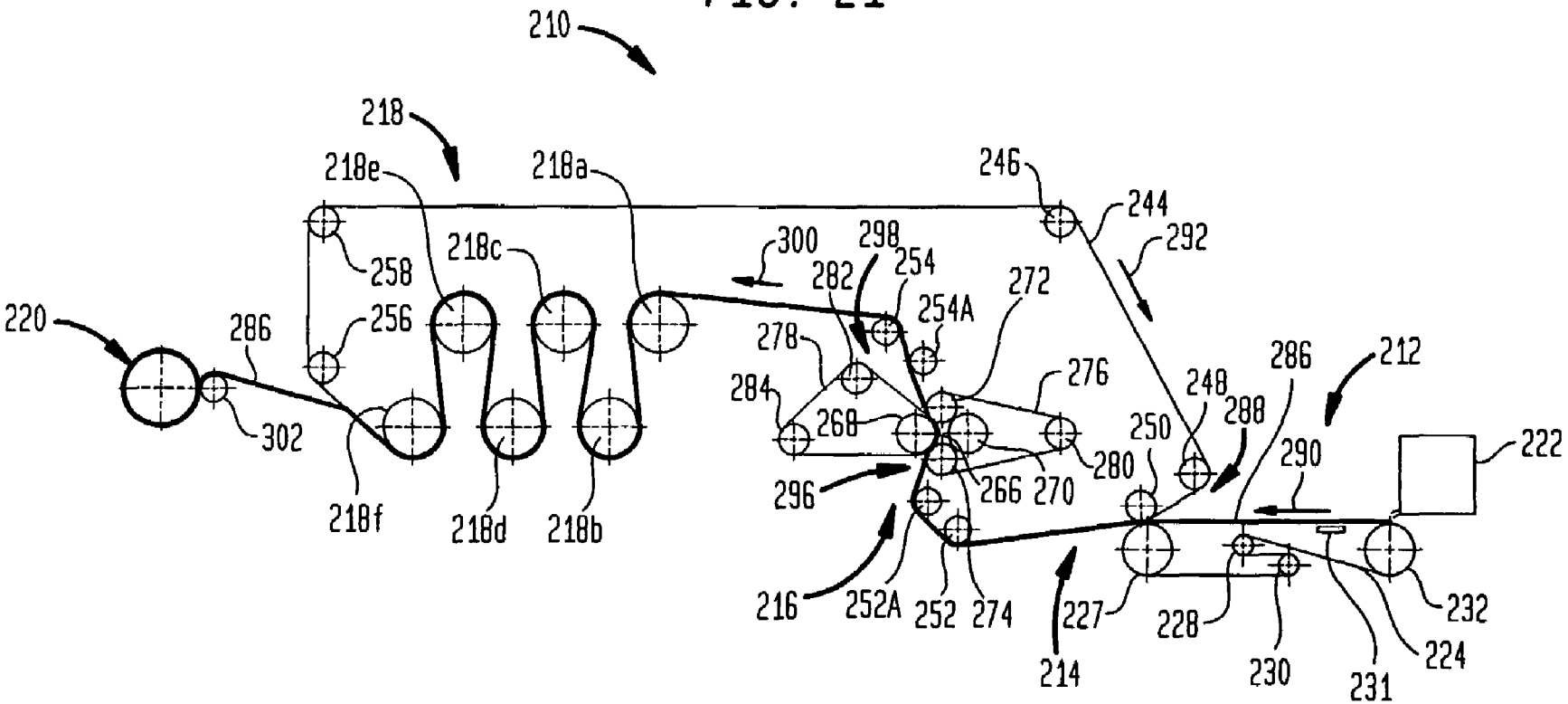
FIG. 21 is a schematic diagram of yet another paper machine useful for practicing the process of the present invention.

Referring to FIG. 21, there is shown yet another paper machine 210 useful for practicing the present invention. Paper machine 210 has a forming section 212, a fabric crepe area 214, a pneumatic dewatering station 216, a drying section 218, as well as a wind-up reel 220. Forming section 212 includes a head box 222, as well as a forming wire 224, as parts of a Fourdrinier former. Fabric 224 is thus supported on forming roll 232 which may be a suction forming roll as noted above. The fabric is likewise supported by support rolls 227, 228, and 230. Optionally provided is a vacuum dewatering box or boxes at the forming table indicated generally at 231.

Forming wire 224 is configured to convey the web to open texture fabric 244 in much the same manner as indicated in FIGS. 19 and 20 discussed above. Open texture fabric 244 is mounted about rolls 246, 248, 250, 252, 252A, 254, 254A, 256, 258, as well as drying cans 218*a*, 218*b*, 218*c*, 218*d*, 218*e* and 218*f*. The fabric is also supported by the rolls forming the pressure chamber as was discussed above in connection with FIGS. 19 and 20 (These parts are numbered 200 numerals higher for illustration). The drying section includes the drying cans 218*a* and so forth whereas the take-up reel may include a cooperating roll 302.

Pneumatic dewatering station 216 includes a pressure chamber 266 defined, in part, by rolls 268, 270, 272 and 274. Also provided are membrane 276 and felt 278 which are supported on rolls 280, 272 and 274 and 268, 282, and 284 respectively as is shown in the diagram. In order to form absorbent sheet, furnish is deposited from head box 222 onto Fourdrinier forming wire 224 and vacuumed dewatered by roll 232 as well as optionally by suction box(es) 231 and a steam shroud to form a nascent web 286. Web 286 is conveyed in the direction indicated by arrow 290 to a rush transfer nip 288. At nip 288 the web has a consistency of from about 20 to 25 percent. There, the web is transferred under rush transfer conditions to open texture fabric 244. Typically a Rush Transfer Ratio of 10 to 30 percent is applied to the web at this point. That is to say the web is subjected to micro-contraction as is known in the art by virtue of the fact that fabric 224 travels in a direction 290 faster than fabric 244 travels in direction 292. From the rush transfer nip the web is conveyed to dewatering station and passes through pressure entry nip 296 into pressure chamber 266 which is maintained at elevated pressure. By virtue of this pressure, air or other dewatering gas, is forced through membrane 276, fabric 244, the web, as well as felt 278 through cylinder 268 or otherwise exhausted. The web is here dewatered preferably to a consistency of from about 45 to about 50 percent. After dewatering, the web exits at pressure exit nip 298 and continues on fabric 244 in the direction of arrow 300 through drying section 218. On drying cans 218*a* through 218*f* the web is further dried to a consistency of from about 94 to about 98 percent prior to being reeled on reel 220.

Figure 22:
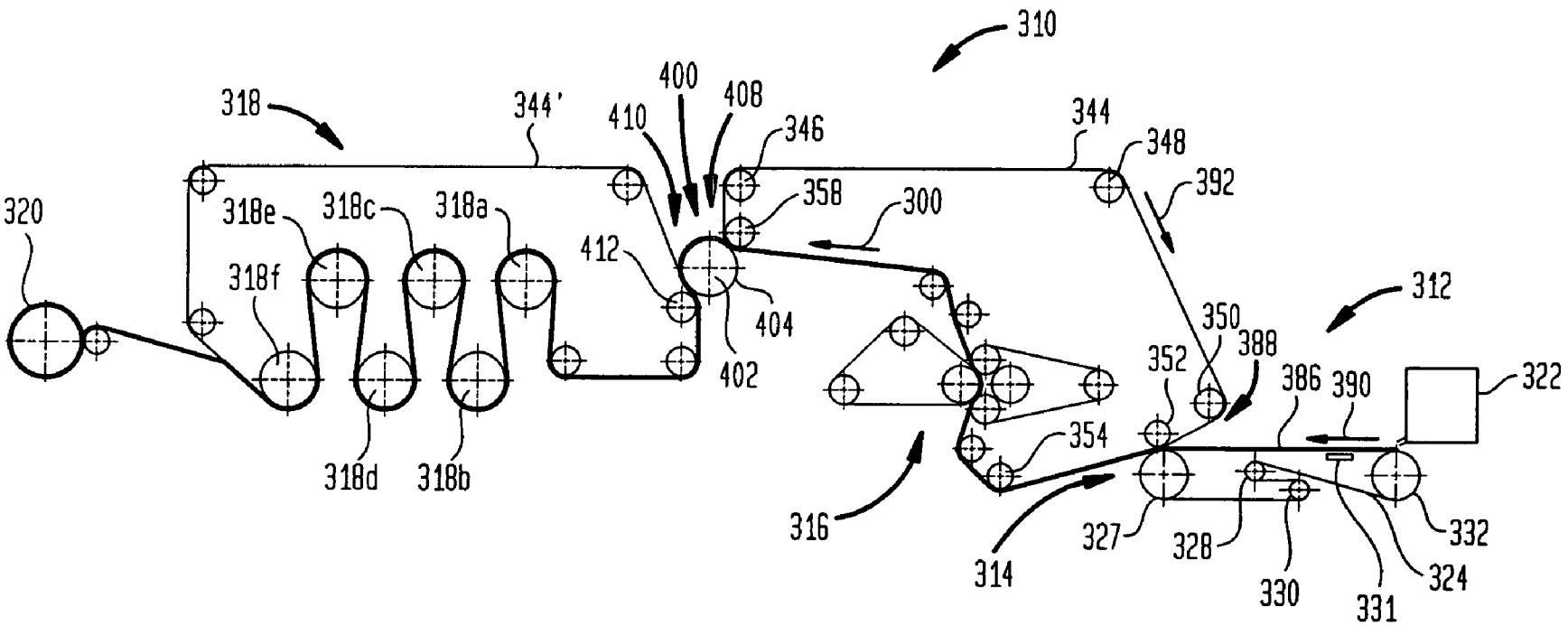
FIG. 22 is a schematic diagram of still yet another paper machine useful for practicing the process of the present invention.

Referring to FIG. 22, there is shown still yet another paper machine 310 useful for practicing the present invention. Paper machine 310 has a forming section 312, a rush transfer area 314, a pneumatic dewatering station 316, a high solids fabric crepe station 400, a drying section 318, as well as a wind-up reel 320. Forming section 312 includes a head box 322, as well as a forming wire 324, as parts of a Fourdrinier former. Fabric 324 is thus supported on forming roll 332 which may be a suction forming roll as noted above. The fabric is likewise supported by support rolls 327, 328, and 330. Optionally provided are vacuum dewatering boxes indicated generally at 331.

Forming wire 324 is configured to convey the web to open texture fabric 344 in much the same manner as indicated in FIGS. 19, 20 and 21 discussed above. Fabric 344 is an open texture fabric and is mounted about rolls 346, 348, 350, 352, 356 and so forth as well as press roll 358. Pneumatic dewatering station 316 is essentially the same as station 216 described above.

In order to form absorbent sheet, furnish is deposited from head box 322 onto Fourdrinier forming wire 324 and vacuumed dewatered by roll 332 as well as optionally by suction box 331 to form a nascent web 386. Web 386 is conveyed in the direction indicated by arrow 390 to rush transfer nip 388. At nip 388 the web has a consistency of from about 20 to 25 percent. There, the web is transferred under rush transfer conditions to open texture fabric 344. Typically a Rush Transfer Ratio of 10 to 30 percent is applied to the web at this point. That is to say the web is subjected to micro-contraction as is known in the art by virtue of the fact that fabric 324 travels in a direction 390 faster than fabric 344 travels in direction 392. From the creping nip the web is conveyed to dewatering station 316 and passes through pressure entry nip into the pressure chamber which is maintained at elevated pressure. By virtue of this pressure, air or other dewatering gas, is forced through the wet web. The web is here dewatered preferably to a consistency of from about 30 to about 60 percent. After pneumatic dewatering, the web exits the chamber and continues on fabric 344 in the direction of arrow 300. At this point in the process, the fiber has an apparently random distribution of fiber orientation.

As the web proceeds in the machine direction it is typically raised to a consistency of from about 30 to about 60 percent before being transferred to transfer roll 402. Transfer roll 402 has a rotating transfer surface 404 rotating at a pre-determined speed. The web is transferred from fabric 344 to surface 404 of roll 402 by way of press roll 358. Roll 358 may be a shoe press roll, optionally incorporating a shoe in order to assist in transferring the web. Inasmuch as fabric 344 is an impression fabric or a dryer fabric, there is not substantial change in the consistency of the web upon transfer to rotating cylinder 402 and the transfer preferably is non-compactive. The transfer occurs in transfer nip 408 whereupon, web 386 is transferred to surface 404 of cylinder 402 and conveyed to another open texture fabric 344'.

A creping adhesive is optionally used to secure the web to the surface of cylinder 402.

The web is creped from surface 404 in a creping nip 410 wherein the web is transferred to and most preferably rearranged on the creping fabric, so that it no longer has an apparently random distribution of fiber orientation, rather the orientation is patterned. That is to say, the web has non-random orientation bias in a direction other than the machine-direction after it has been creped. To improve processing, it is preferred that a creping roll 412 has a relatively soft cover, for example, a cover with a Pusey and Jones hardness of from about 25 to about 90.

The fabric creping in nip 410 occurs under pressure, that is, roll 412 and creping fabric 344' is loaded against roll 402 with a pressure of from about 40 to about 80 pounds per linear inch (pli). Fabric 344' travels at a lower speed than surface 404 of cylinder 402, whereby a Fabric Crepe of 10, 20, 40 percent or more may be applied to the web.

After creping, the web is dried with cans 318*a*-318*f* and wound up on reel 320 as discussed in connection with the other embodiments.

Suitable components for pneumatic dewatering station 16, 116, 216 and 316 are found in the following U.S. patents and patent application Publications: (i) Patents—U.S. Pat. No. 6,645,420, entitled "Method of Forming a Semipermeable Membrane With Intercommunicating Pores for a Pressing Apparatus"; U.S. Pat. No. 6,616,812, entitled "Anti-Rewet Felt for Use in a Papermaking Machine"; U.S. Pat. No. 6,589,394, entitled "Controlled-Force End Seal Arrangement for an Air Press of a Papermaking Machine"; U.S. Pat. No. 6,562,198, entitled "Cross-Directional, Interlocking of Rolls in an Air Press of a Papermaking Machine"; U.S. Pat. No. 6,419,793, entitled "Paper Making Apparatus Having Pressurized Chamber"; U.S. Pat. No. 6,416,631, entitled "Pressing Apparatus Having Semipermeable Membrane"; U.S. Pat. No. 6,381,868, entitled "Device for Dewatering a Material Web"; U.S. Pat. No. 6,287,427, entitled "Pressing Apparatus Having Chamber Sealing"; U.S. Pat. No. 6,274,042, entitled "Semipermeable Membrane for Pressing Apparatus"; U.S. Pat. No. 6,248,203, entitled "Fiber Web Lamination and Coating Apparatus Having Pressurized Chamber"; U.S. Pat. No. 6,190,506, entitled "Paper Making Apparatus Having Pressurized Chamber"; and U.S. Pat. No. 6,161,303, entitled "Pressing Apparatus Having Chamber End Sealing"; (ii) Publications—2004/0089168, entitled "Semipermeable Membrane With Intercommunicating Pores for Pressing Apparatus"; 2003/0153443, entitled "Elastic Roller for a Pressing Apparatus"; 2003/0146581, entitled "Sealing Arrangement"; 2003/0056925, entitled "Anti-Rewet Felt for Use in a Papermaking Machine"; 2003/0056923, entitled "Controlled-Force End Seal Arrangement for an Air Press of a Papermaking Machine"; 2003/0056922, entitled "Main Roll for an Air Press of a Papermaking Machine"; 2003/0056921, entitled "Cross-Directional Interlocking of Rolls in an Air Press of a Papermaking Machine"; and 2003/0056919, entitled "Cleaning a Semipermeable Membrane in a Papermaking Machine".

While the invention has been described in connection with several examples, modifications to those examples within the spirit and scope of the invention will be readily apparent to those of skill in the art. In view of the foregoing discussion, relevant knowledge in the art and references including copending applications [discussed above in connection with the Background and Detailed Description, the disclosures of which are all incorporated herein by reference, further description is deemed unnecessary.

What is claimed is:

1. A method of making an absorbent cellulosic sheet comprising:

a) forming a nascent web having an apparently random distribution of fiber orientation from a papermaking furnish;

b) rush transferring the web to an open texture fabric;

c) drying the web to a consistency of from about 30 to about 60 percent by way of (i) combining the open texture fabric bearing said web with a fluid distribution membrane and an anti-rewet felt as the three pass through a nip into a pressure chamber defined in part by a plurality of nip rolls, the fluid distribution membrane bearing against the side of the open texture fabric away from the web, with the anti-rewet felt bearing against the web, and (ii) applying a pneumatic pressure gradient from the fluid distribution membrane through the web thereby dewatering the web;

d) thereafter transferring the web to a translating transfer surface moving at a first speed;

e) fabric-creping the web from the transfer surface at a consistency of from about 30 to about 60 percent utilizing a creping fabric, the creping step occurring under pressure in a fabric creping nip defined between the transfer surface and the creping fabric wherein the fabric is traveling at a second speed slower than the speed of said transfer surface, the fabric pattern, nip parameters, velocity delta and web consistency being selected such that the web is creped from the surface and redistributed on the creping fabric to form a web with a reticulum having a plurality of interconnected regions of different fiber orientation including at least (i) a plurality of fiber enriched regions of having an orientation bias in a direction transverse to the machine-direction, interconnected by way of (ii) a plurality of colligating regions whose fiber orientation bias is offset from the fiber orientation of the fiber enriched regions; and f) drying the web.

2. The method according to claim 1, fabric-creped from the transfer surface at a Fabric Crepe of from about 10 to about 100 percent.

3. The method according to claim 1, fabric-creped from the transfer surface at a Fabric Crepe of at least about 40 percent.

4. The method according to claim 1, fabric-creped from the transfer surface at a Fabric Crepe of at least about 60 percent.

5. The method according to claim 1, fabric-creped from the transfer surface at a Fabric Crepe of at least about 80 percent.

6. The method according to claim 1, wherein the transfer surface is the surface of a rotating cylinder.

* * * * *